US007874181B1

(12) United States Patent
Lindahl

(10) Patent No.: US 7,874,181 B1
(45) Date of Patent: Jan. 25, 2011

(54) KNITTING NEEDLE WITH ERGONOMIC CONFIGURATION

(76) Inventor: Sandra Kay Lindahl, 503 - 72nd St., Holmes Beach, FL (US) 34217

( * ) Notice: Subject to any disclaimer, the term of this patent is extended or adjusted under 35 U.S.C. 154(b) by 0 days.

(21) Appl. No.: 12/361,363

(22) Filed: Jan. 28, 2009

(51) Int. Cl.
*D04B 3/02* (2006.01)

(52) U.S. Cl. ..... 66/117

(58) Field of Classification Search ..... 66/1 A, 66/116, 117, 118
See application file for complete search history.

(56) References Cited

U.S. PATENT DOCUMENTS

| | | | | | |
|---|---|---|---|---|---|
| 1,091,395 | A | * | 3/1914 | Sencenbaugh | 66/118 |
| 1,355,878 | A | * | 10/1920 | Akin | 66/118 |
| 1,358,067 | A | * | 11/1920 | Ensfield | 66/118 |
| 1,376,151 | A | * | 4/1921 | Mitchell | 66/118 |
| 1,415,472 | A | * | 5/1922 | Puc | 66/118 |
| 1,477,427 | A | * | 12/1923 | Christensen | 66/118 |
| 1,502,584 | A | * | 7/1924 | Perry | 66/118 |
| 1,518,961 | A | * | 12/1924 | Burns | 66/118 |
| 1,536,274 | A | * | 5/1925 | Semonsen | 66/117 |
| RE16,360 | E | * | 6/1926 | Stephens | 66/117 |
| 1,587,082 | A | * | 6/1926 | Mattern | 473/201 |
| 1,692,583 | A | * | 11/1928 | Shepperack | 66/117 |
| 1,709,631 | A | * | 4/1929 | Schmidt | 66/117 |
| 2,117,143 | A | * | 5/1938 | Burger | 66/117 |
| 2,246,254 | A | * | 6/1941 | Johnston | 66/118 |
| 2,276,062 | A | * | 3/1942 | Peyser | 235/114 |
| 2,290,432 | A | * | 7/1942 | Hokstad | 66/117 |
| 2,364,649 | A | * | 12/1944 | Palliser | 66/117 |
| 2,440,413 | A | * | 4/1948 | Mock | 66/118 |
| 2,465,636 | A | * | 3/1949 | Doerr | 66/118 |
| 2,486,184 | A | * | 10/1949 | Maker et al. | 66/117 |
| 2,507,174 | A | * | 5/1950 | Phillips | 66/118 |
| 2,538,635 | A | * | 1/1951 | Wahle | 66/117 |
| 2,601,769 | A | * | 7/1952 | Visconti | 66/118 |
| 2,608,077 | A | * | 8/1952 | Suessman | 66/118 |
| 2,635,444 | A | * | 4/1953 | Carlson | 66/118 |
| 2,738,662 | A | * | 3/1956 | Carlson | 66/118 |
| 3,228,212 | A | * | 1/1966 | Huber | 66/117 |
| 3,678,712 | A | * | 7/1972 | Singleton | 66/118 |
| 3,732,869 | A | * | 5/1973 | Bronstein | 606/118 |
| 4,047,397 | A | * | 9/1977 | Laliberte | 66/118 |
| 4,280,641 | A | * | 7/1981 | Eacret | 223/1 |

(Continued)

FOREIGN PATENT DOCUMENTS

| | | |
|---|---|---|
| JP | 10-131003 | 5/1998 |

*Primary Examiner*—Danny Worrell
(74) *Attorney, Agent, or Firm*—Dorothy S. Morse

(57) ABSTRACT

A knitting needle with one or more elevation changes that provide ergonomic benefit on the portions of its shaft typically held by knitters during stitch/loop creation, to allow knitting with enhanced comfort, faster knitting, and/or knitting for longer periods of time with less risk of hands becoming prematurely tired, numb, or aching from the repetitive motion inherent in knitting activity. The needle may also have different cross-sectional configurations that provide additional ergonomic benefit, in place of the traditional circular shape still most commonly used. The elevation changes are not positioned on the pointed tip of the needle, or within approximately one-and-one-half to two inches thereof, and are not so configured or pronounced as to interfere with the easy movement of stitches along the needle's shaft. A tube or post may further be added to the end cap on the non-pointed end of a single-point needle for convenient point protector mounting.

20 Claims, 9 Drawing Sheets

U.S. PATENT DOCUMENTS

D270,783 S 10/1983 Okada
D273,347 S 4/1984 Okada
4,646,543 A * 3/1987 Okada ..... 66/117
5,042,804 A * 8/1991 Uke et al. ..... 473/538
D567,438 S * 4/2008 Srivastava ..... D28/10
D567,439 S * 4/2008 Srivastava ..... D28/10

* cited by examiner

KNITTING NEEDLE WITH ERGONOMIC CONFIGURATION

CROSS-REFERENCES TO RELATED APPLICATIONS

This patent application claims domestic priority from U.S. design patent application No. 29/325,343, filed by the same inventor for similar subject matter on Sep. 29, 2008 and having the title of "Knitting Needle With Ergonomic Configuration". In addition, this patent application also claims domestic priority from U.S. design patent application No. 29/325,345, filed by the same inventor for similar subject matter on Sep. 29, 2008 and having the title of "Knitting Needle Cap With Point Protector Mounting Projection". All benefit of these previously filed pending U.S. applications to which the applicant is entitled is herein requested.

BACKGROUND

1. Field of the Invention

This invention relates to elongated hand-held instruments or tools with at least one pointed end that are used for knitting yarn, fibers, strands and/or other elongated filamentous material into two-dimensional and three-dimensional shapes via the repeated pulling of new loops through one or more stitches/loops already on a donor shaft, and then concurrent or subsequent transfer thereof from the donor shaft to a recipient shaft, specifically to elongated knitting needles with one or more elevation changes associated its shaft's exterior surface (raised protrusions, depressions, or both) that are structured to provide ergonomic advantage and positioned at a minimum in the area of the shaft most likely to be held between the knitter's fingertips and other portions of knitter's hands during new stitch/loop creation and transfer, wherein the stiffness and numbness commonly experienced in knitter's fingers and hands are diminished so as to allow longer knitting with enhanced comfort. It is contemplated for the diminishment to occur in both hands of a knitter, and whether knitting is conducted right-handed or left-handed, or using English, Continental, or other common knitting methods. It is further contemplated for present invention elevation changes to have sufficient height, depth, and/or shape to provide ergonomic benefit, but not create drag against free-flowing stitch/loop movement or otherwise interfere with the easy sliding of the stitches/loops across the shaft. However, since smaller sizes of knitting needles have a very small outside diameter (O.D.) dimension (for example, the O.D. of a size 4 standard knitting needle shaft is only one-eighth of an inch), to preserve the structural integrity of the present invention shaft, when elevation changes include depressions their depth dimensions would correspondingly be very small. Therefore, depending in part upon the O.D. of a present invention knitting needle shaft, it is contemplated for the elevation changes on the most preferred present invention knitting needles to have a raised height or depth dimension ranging between approximately 0.0004 inches and approximately 4 to 5 millimeters, and to be positioned at least in part along the shaft's exterior surface between approximately two inches and five inches from a pointed tip/end on a single-point knitting needle shaft or from each pointed tip/end on a double-point knitting needle shaft. Raised protrusions having a near maximum thickness dimension may be given laterally tapered edges to avoid any hindrance against the easy-flowing and effortless movement of stitches/loops over the present invention's shaft. In contrast, for decorative content, or to provide a cost reduction or other manufacturing benefit, the present invention elevation changes can be extended longitudinally to more (or all) of the shaft's exterior surface. Furthermore, the present invention elevation changes can be in structured or random patterns, and may comprise many differing shapes and dimensions, including but not limited to a single spiraling protrusion, multiple spaced-apart small designs of the same or different configuration and depth, multiple spaced-apart large designs of the same or different configuration and depth, a combination of large and small spaced-apart designs, or a combination of elevation changes having differing size, perimeter shape, and thickness dimension from one another. Since it is not contemplated for the present invention elevation changes to be located on the shaft's pointed tip/end, or within approximately one to one-and-one-half inches thereof, non-raised pattern extensions can optionally be used in these areas and comprise color and/or design similarity to the raised protrusions or depressions used on the associated knitting needle shaft, or in the alternative at least in part create a color contrast thereto.

In addition to elevation changes, ergonomic benefit as a result of present invention use may also be optionally provided by a variety of non-circular cross-sectional configurations of the present invention knitting needle shaft (at least in the area of the shaft most likely to be held between the knitter's fingertips and other portions of knitter's hands during new stitch/loop creation and transfer). Such non-circular cross-sectional configurations can include, but are not limited to, that of a triangle with softened corners/edges, in place of the traditional and non-ergonomic circular cross-section knitting needle shape historically and still most commonly used by knitters today (which is in large part responsible for the numbness currently experienced in a knitter's finger and hands with extended use). However, in the present invention it is not contemplated for the non-circular cross-sectional configurations to extend into the tapering work area used for stitch transfer that is located adjacent to the shaft's pointed tip/end. One reason that the present invention elevation changes and non-circular cross-sectional shaft configurations are able to provide knitters with ergonomic benefit is that in addition to engaging in stitch/loop transfer, part of the knitting process requires a knitter to frequently release one or more of the knitting needle shafts to conduct auxiliary knitting activity, such as, but not limited to, varying combinations of moving a group of recently transferred stitches/loops away from the pointed end/tip of a recipient needle, crowding together several stitches/loops close to the pointed end/tip of a donor needle in advance of stitch/loop creation, spreading apart stitches to check pattern accuracy, and/or counting rows or otherwise measuring the length of a work-in-progress. When the knitter re-grasps the shaft after such auxiliary knitting steps, the knitter's hand/finger tissue nearly always becomes re-aligned with a different portion of the shaft (or a rotation of the shaft occurs that re-aligns the knitter's hand/finger tissue), each of which results in needed circulatory relief to the portions of the knitter's hands and fingers previously in contact with the shaft and as a result thereof experiencing diminished blood circulation. Thus, the ergonomic relief provided by the present invention allows knitters to work longer in comfort, faster, more efficiently, and with increased knitting enjoyment. By way of contrast, knitters re-grasping knitting needles with a circular cross-section (after conducting auxiliary knitting activity) would be provided with an identical grip to that established before knitting needle shaft release, even if shaft rotation had taken place, wherein the hand/finger tissue of the knitter in contact with the shaft would continue to experience poor blood circulation, eventually leading to premature hand and finger fatigue.

The patterns created by the elevation changes on a present invention knitting needle shaft can be structured or random; its raised protrusions and/or depressions can have uniform or varying shape, size, thickness, and/or depth; and any lines, grooves, or channels used thereon (such as those used to provide a spiral pattern) can have identical or different widths, heights, and/or depths. Furthermore, raised protrusions and depressions in the present invention can be the same color as the remaining portions of the exterior surface of the knitting needle shaft, or provide decorative enhancement through at least partial color contrast with the knitting needle shaft via use of one or more distinguishing colors, which can further have a stylized arrangement of their own to provide yet another aspect of decorative enhancement. The elevation changes and the non-circular cross-sectional configurations used with present invention knitting needle shafts can work alone or together to give knitters many opportunities to vary contact point alignment with their hands and fingers during knitting activity, both consciously when the knitter feels hands and fingers beginning to tire and purposefully repositions them around a knitting needle shaft (or rotates the shaft) in an attempt to seek relief, and inadvertently when the knitter stops stitch/loop creation to conduct one of many other auxiliary activities related to the knitting process, as mentioned above or to count stitches/loops in advance of beginning a new pattern step, attach a new skein of yarn or other type of filamentous strand, pick up one or more dropped stitches, or just to admire the appearance of the work-in-progress, wherein after such activity is conducted the knitter re-grasps the knitting needle shaft and typically obtains a different hand/finger alignment with the shaft.

The easy sliding of stitches off the pointed end/tip of a donor knitting needle and onto a recipient needle enhances knitting speed, and therefore should be preserved by any knitting needle modification. To assist in maintaining this advantage, the present invention may extend the area of no elevation change from approximately one to one-and-one-half inches from any pointed end/tip present that is used for new stitch/loop creation, to approximately two or two-and-one-half inches. This is particularly helpful when knitters employ filaments having very large diameter dimension, require the use of very large diameter knitting needle shafts to achieve a needed look in a finished project, require additional working room for accomplishing complex stitch patterns, to facilitate gauge accuracy, and/or for any other reason benefiting the knitter. Should a circular knitting needle configuration be optionally contemplated for use in the present invention, it is preferred that elevation changes extend substantially across each of its two rigid members (shortened shafts) that are employed for new stitch/loop creation, but not extend onto the working ends of either rigid member, which at a minimum includes the pointed end/tip and the tapering work area adjacent thereto, to provide a similar arrangement of elevation change to that used in present invention single-point and double-point knitting needles. In addition, although present invention elevation changes could extend onto the typically smaller-diameter flexible filament (plastic tubing or other, hereinafter also referred to as 'circular needle filament' without any intent of limitation) used in a circular needle to join the two rigid members together, the circular needle filament is not typically held by knitters during new stitch/loop creation and, other than decorative enhancement, it is contemplated that little ergonomic or other benefit would be derived from applying elevation change to the circular needle filament. Thus, it is to be considered within the scope of the present invention for elevation changes to be added to a circular needle filament, such as when a manufacturing advantage is provided or in response to a desire for enhanced decorative appeal, or when another desired benefit or advantage is contemplated, however, the use of elevation changes on present invention circular needle filaments is not considered critical.

It is further contemplated for the present invention knitting needles with their elevation changes (or combination of elevation changes and non-circular cross-sectional configuration) to have many different diameter and length dimensions, including standard knitting needle sizes, so that knitters are not required to make any fundamental changes in their knitting habits to achieve the gauge recommendations displayed in knitting pattern books and/or other currently available printed knitting instructions. Furthermore, to provide additional time-saving convenience for knitters, it is also contemplated for the present invention to optionally include a modification of the end cap routinely used on the non-pointed end of single-point knitting needles, wherein a tube or post would be added to the end cap as a mounting projection configured to provide a fixed storage location for a point protector while knitting activity occurs, with the point protector then remaining close to the knitter so that it can be readily accessed for use over the pointed end of the knitting needle after knitting activity ceases, to prevent stitches/loops remaining on a knitting needle shaft from inadvertently traveling beyond its pointed/tip end while knitting activity is temporarily suspended. Even if the work-in-progress being created by a knitter requires double-point needles or a circular knitting needle instead of single-point needles, point protectors mounted on the end caps of one or more single-point present invention knitting needles that are located in a nearby knitting bag would provide quick access and benefit to the knitter, as the needles could be readily located in the bag (better than if stored in a small container that is likely to fall to the bottom of the bag) and the point protectors would be readily extractable from their associated mounting projections for prompt use.

2. Description of the Related Art

Manual knitting is a creative activity, and often a labor of love that is enjoyed by those doing it, and knitters will commonly spend long periods of time on a work-in-progress, sometimes to their physical detriment. Furthermore, people who enjoy knitting will often continue it throughout their lifetime, even when arthritis and various joint problems experienced as they age make it more difficult to perform. A current and common complaint among knitters of all ages is that their hands and fingers frequently become tired and ache as a result of their knitting activity, and the numbing condition of decreased circulation that is commonly referred to as the sensation of "pins and needles" also frequently occurs in fingertips, and elsewhere. Furthermore, it is common for devoted knitters, as well as those merely trying to expedite a project, to knit for long periods of time in a seated position, frequently saying to themselves time after time, "just one more row". Thus, in addition to finger and hand fatigue, the knitter's arms, shoulders, and back can also experience discomfort as a result of the long hours the knitter will choose to dedicate to various knitting projects. However, most knitters enjoy the creative process enough that they are unwilling to stop knitting even if temporary discomfort exists. Knitting is also a widespread and longstanding activity, with the same knitting needles having a circular cross-sectional configuration and a smooth exterior surface being passed down in families from one generation to the next, as new knitting enthusiasts develop. Furthermore, knitting is typically accomplished by a person in a seated position, with knitting needles held in an elevated position at or above waist level for optimum visibility of stitch/loop creation from the pointed end/tip of a donor knitting needle to the pointed end/tip of a recipient knitting needle, while one or more new loops are repeatedly pulled through existing stitches from a strand of yarn or fiber wrapped over the donor needle by a knitter's finger and then transferred onto the shaft of a recipient needle, or in the alternative while multiple stitches are periodically bound off or knitted together into a single stitch to decrease the number of stitches on a knitting needle shaft. Common knitting techniques include the English method where a strand for new loop creation is introduced by the right hand, and the European or Continental method where the strand is introduced by the left hand, with right-handed and left-handed knitting mainly differing by the portion of an established stitch used for new stitch/loop creation and the clockwise or counterclockwise direction used for strand introduction. In addition, knitting needle shafts can be held initially with a pencil grip, but as more rows of knitted stitches are added (particularly when a large number of stitches are supported by a shaft), knitters will typically adjust their hand positions on a knitting needle shaft to a knife grip. However, irrespective of the knitting technique used, continued and/or repeated pressure by varying portions of the knitter's hands and fingers against a knitting needle shaft is needed to achieve a high level of precision during new loop creation and stitch/loop transfer, to enhance knitting speed, to promote even strand tension, and to promote a uniform appearance in the work-in-progress, and it is this same precise, consistent, and repetitive knitting movement that results in, or at least contributes to, the tired, achy, and numb hands and forearms characteristic for many knitters. Also contributing to knitter discomfort and injury is the weight of the portion of a work-in-progress hanging from the needles and extending between the needles and the knitter's lap (or a table top or other support surface in front of the knitter), which is supported by the knitter's fingers, hands, and forearms as they extend out in front of the seated knitter. As one can imagine, a large knitted piece having more than one hundred stitches on a knitting needle at a time, such as the front or back of an adult sweater, a shawl or poncho, or an afghan, will become quite heavy for the knitter's fingers and hands to support, and will also eventually provide an adverse affect on the knitter's fingers, hands, wrists, forearms, shoulders, and/or back should knitting activity extend over a long period of time or be conducted repeatedly on successive days, particularly when heavier weight yarns are involved. Nearly all knitters have at least one pair of bent plastic or metal knitting needle in their knitting bag, evidence of the strong gravitational forces affecting a knitter's fingers, hands, and arms. By their devotion to knitting activity over a period of years, knitters can also risk repetitive motion injury such as carpal tunnel injury, arthritic pain, joint problems, and/or permanent finger deformity. Although circular needles, via the bendable and flexible nature of its central filament, will allow more of the weight of a work-in-progress to be supported by the knitter's lap (table-top or other support surface placed in front of a seated knitter), a sufficient amount of yarn weight will remain suspended from the two rigid members held by the knitters' fingers and hands to provide the risk of permanent injury to them over time. Furthermore, the sole use of circular needles is not the knitters' panacea, as circular needles are not easily adaptable to all knitting projects, requiring skilled knitters with varying interests (and those following older patterns) to frequently use single-point and double-point knitting needles which hold all of the stitches on them in an elevated position at or near waist level.

Correct and consistent tension is also an important aspect of knitting that is needed to produce an even and aesthetically appealing look in many finished projects, as well as insure that a knitted piece of clothing is true-to-size, and knitters must focus consciously or unconsciously (out of habit) on providing proper yarn/fiber/strand tension during new loop/stitch creation. However, providing proper tension also contributes to knitters' discomfort and risk of injury when knitting needles having a smooth exterior surface and a circular cross-section are used, since tension control in part requires a firm grasp of the knitting needle shaft by at least some of the knitter's fingers, which can quickly lead to decreased blood circulation in them. An additional contribution to a knitter's injury risk is the fact that the knitter's hands must support the needles (although typically lightweight) in a substantially fixed orientation and distance in front of the seated knitter where visibility is optimal, as well as support the suspended portion of a work-in-progress that usually becomes increasingly heavy until the steps of decreasing stitches or binding off start to occur, such as that needed to prepare a sleeve cap. The inventor herein sought a solution to the problem from three different approaches, first by focusing on possible changes to the knitting process, second by focusing on possible changes to knitters' hands, or third by focusing on possible changes to the knitting needle. Since the knitting activity as it is known today has been conducted for such a long time and is so widespread, in its traditional forms, and due to the fact that there are so many published patterns available to knitters that they already like and would want to try in a new color or repeat in a different size, changing the fundamentals of the knitting process appears to be a monumental task that would take a significant amount of time to bring into the mainstream. Therefore, this approach was not considered a viable alternative to pursue, since it would provide no immediate relief to current knitters who are set in their ways and not amenable to trying a completely different approach. Changing the configuration of a knitter's hands could involve padding, similar to the concept of providing padded cycling gloves for the prevention of numbness in the hands and forearms of cyclists during long rides. However, the addition of padding to one or more of a knitter's fingers, or placing padded gloves over one or both of the knitter's hands, would be likely to slow down stitch/loop creation and at least initially have an adverse impact on the knitter's tension until the knitter could make appropriate adjustment to accommodate the change. Furthermore, padding or gloves would remove some of the tactile pleasure in the knitting process relating to the soft feel of some yarns, would need periodic laundering to remove natural skin oils or lotion residues that could adversely affect the condition of a work-in-progress, and may tend to cause some knitters working in warmer surroundings to become unnecessarily overheated unless the padding or gloves were made from breathable materials. Therefore, it was concluded that even if padded gloves or other padding were made available to knitters, many would prefer to work without it, seeing the disadvantages of padding/gloves as outweighing their benefits.

The last approach considered by the inventor herein was to change the knitting needle itself. However, since the knitting needles with a circular cross-section and a smooth exterior surface that were used by our grandparents and their ancestors, are still widely and commonly used today in spite of their tendency to cause discomfort with extended use, for a knitting needle modification that ergonomically benefits knitters' hands to become widely adopted, it would have to not radically change the way knitting needle shafts are held in the fingers and hand. In addition, the change cannot involve the use of soft and/or resilient materials, or the tension and gauge of a finished product could be affected and the ease of stitch/ loop movement across such a knitting needle would be diminished. Thus, to solve the problem of hand fatigue experienced by knitters and the other problems encountered by knitters that are mentioned hereinabove, the present invention implements the use of non-resilient protrusions and other elevation changes on knitting needle shafts at least in the areas thereof anticipated to be most commonly held by knitters during new loop/stitch creation. Typically this area is approximately one-inch to approximately two-and-one-half inches from any pointed end/tip associated with the shaft, and extends a minimum linear distance along the shaft of approximately one-and-one-half inches to approximately three inches. In addition, present invention knitting needle shafts may also optionally comprise ergonomically-enhancing cross-sectional configuration changes (distinct from the traditional knitting needle shafts having a circular cross-sectional configuration). Thus, in some applications the use of elevation changes on knitting needles having circular shafts may provide sufficient ergonomic benefit in a needed application, whereas other applications (such as but not limited to those involving the use of heavier weight yarns or where very small knitting needles are involved that are difficult and tedious to hold) may require elevation changes and a shaft with a non-circular cross-sectional configuration to provide knitters with optimal ergonomic benefit. In searching the Internet and retail stores for prior art changes to the traditional knitting needles having a circular cross-sectional configuration, a few needles can be found for sale that have a square cross-sectional configuration. Two Internet sites, www.yarnbazaar.com and www.yarnmarket.com, include illustrations of a square knitting needle, but many other websites lack any reference thereto and square knitting needles do not appear to be widely sold or adopted by knitters for any ergonomic or other benefit. The only other variation from the traditional knitting needle commonly found on websites selling knitting supplies are those having end caps with artistic designs, such as the shape of flower petals, animals, colorful/abstract forms, as well as the shape of kitchenware (teapot), human faces, and types of food (such as a strawberry). Thus, although many retail stores on and off the Internet can be located that sell knitting needles, including mega-mart stores, except for the changes noted above to a few knitting needles, the vast majority of knitting needles currently sold are the same well-known needles with a circular cross-sectional configuration and a smooth/uniform exterior surface, with the single-point needles typically sold having an end cap with a terminal flange that is used to display the manufacturer's name and needle size.

In contrast, a search of the U.S. Patent Office database and the databases of several foreign patent offices and other patent organizations, reveals many variations of the traditionally used knitting needle for differing purposes, but none providing ergonomic structure or benefit similar to that provided by the present invention. For example, U.S. Pat. No. 7,114,354 to Dremann (2006) provides an internally illuminated knitting needle for working with dark yarns, U.S. Design patent D526477 to Jost (2006) provides a knitting needle with measuring increments marked along its length, and U.S. Pat. No. 6,904,773 to Cushman (2005) provides nested knitting needles that allow smaller needles to progressively be stored within the next larger needle. In addition, several published patent applications and patents disclose circular knitting needle improvements, such as WO/2007/008415 to Eley-Holden-Sotnik (2007) that discloses an elastic cord between its two needles, or U.S. Pat. No. 6,397,640 to Williams (2002) that discloses two knitting needles each with an elongated channel that are used together to slidably engage the ends of a flexible cable for knitting small circumferential areas. A few patents for knitting needle kits also reveal interchangeable components that allow the use of shared components to make differing configurations and sizes of knitting needle appropriate to a specific application. Yet another U.S. Pat. No. 2,446,622 to Turner (1946) discloses a method for producing grips for sports equipment, such as tennis rackets and golf clubs, that include longitudinal, circumferential, and spiral channels carved into a leather or rubber wrapping stretched around portion of the sports equipment handle typically held by its user to improve the user's grip. However, ergonomic benefit as a result of the channels (if any) is not discussed and the wrapped area disclosed by Turner could not be used on a knitting needle shaft as it would not allow stitches/loops to freely move across the shaft, something important if fast knitting speed and uniform knitting activity is desired.

Patents to only two inventors, Hidekazu Okada and Takagi Shosuke, were found to provide surface modification to knitting needles. U.S. Design patent D269,734 to Okada (1983) and U.S. Design patent D271,062 to Okada (1983) respectively show a double point knitting needle and a single point knitting needle each having a plurality of evenly spaced-apart longitudinal striations in parallel relationship to one another that extend completely around the needle's circumference from one end of the needle to the other, including the pointed tips and the tapering stitch/loop transfer area adjacent to each pointed tip. The word "striation" is used as a part of both Okada descriptions to identify the surface modification shown. Although the word "striation" is defined to refer to stripes, lines, or bands distinguished from the surrounding area by color, it may also be used to describe minute grooves, striations, channels, or other change in elevation. In looking at the end views of the Okada invention (provided in FIG. 3 on '734 and FIG. 4 of '062) and the cross-sectional views of the Okada invention (provided in FIG. 4 on '734 and FIG. 5 of '062), one observes a smooth and non-interrupted perimeter line. This is opposed to the indentations shown in longitudinal and cross sectional views of two other Okada U.S. Patents for crochet hooks, U.S. Design patent D270,783 to Okada (1983) and U.S. Design patent D273,347 to Okada (1984), that are represented in the form of notched perimeter lines. In contrast also, the word "striation" was not used in the Okada '783 and '347 crochet hook descriptions. Thus, using the Okada crochet hook disclosures as a basis for "striation" interpretation for the Okada knitting needles, the Okada striations associated with knitting needles provided in the above-referenced U.S. Patents '734 and '062 do not appear to have elevational differentiation from adjacent areas. However, even if they did, the uniformity of the striation spacing shown would not be likely to provide much ergonomic relief to knitters, as when they would re-grasp an Okada knitting needle shaft, the contact points between the knitter's hands and the shaft would often be very close to that used prior to knitting needle release, providing little or no long term circulatory relief. Furthermore, all four of the above mentioned Okada U.S. Design Patents merely show longitudinal and circumferential surface markings similar to that in the disclosure of the above-referenced U.S. Pat. No. '622 to Turner, which described multiple ways in which to enhance the grip of sports equipment handles with a combination of spiral wrappings having gouged surface channels. The second inventor providing surface modification to a knitting needle is Takagi Shosuke, whose invention is disclosed in the Japanese patent abstract 10-131003 published May 19, 1998 (for application number 08-307087 filed Nov. 1, 1996). Ergonomic benefit is identified through the use of a knitting needle with an auxiliary tool that is capable of being readily held by fingers while reducing tired feelings in them. The Takagi Shosuke tool comprises a cylindrical body, preferably tapered on one end, and which is made from rubber or other material with elasticity. However, although the word "knitting needle" is used in the abstract for the Takagi Shosuke invention, the illustrations provided show the crafting tool held by a hand that resembles a crochet hook with hooking members on both of its ends, and as noted above, should elasticity be provided as a part of any modification to the shaft of a knitting needle (particularly a resilient feature that tapers on at least one end), it would increase the difficulty of achieving even stitch/loop tension and could inhibit the easy sliding of stitches/loops back and forth across the knitting needle shaft that is important to the many auxiliary knitting steps frequently performed between periods of stitch/loop transfer, such as checking a work-in-progress for dropped stitches or pattern accuracy. Thus, the Hidekazu Okada and Takagi Shosuke inventions do not appear to provide the same disclosure as the present invention.

Furthermore, there are also quite a few U.S. patents relating to the structure or design of end caps used on single-point knitting needles, that reveal end caps having different structure and/or design from the artistic designs found on the Internet. For example, U.S. Design patent 313,499 to Pollack (1991) discloses a single-point knitting needle with an end cap formed as a result of the non-pointed end of the knitting needle shaft being formed into the shape of a knot. Also, U.S. Design patent D571,098 to Jones (2008) shows the end cap of a single-point knitting needle having the general appearance of a cube, while U.S. Design patent D298,698 to Okada (1998) shows the end cap of a single-point knitting needle having the general appearance of a short cylinder-shaped member. Furthermore, U.S. Design patent D545,562 to Feller (2007) shows the end cap of a single-point knitting needle that increasingly and uniformly widens at its distal end, which has the general appearance of an inverted truncated cone, while U.S. Design patent D556,443 to Mihara (2007) shows the end cap of a single-point knitting needle having a shorter cylindrical portion depending from a larger portion having a generally hour-glass perimeter appearance when viewed from the side. The other U.S. Patents and Published Patent Application found relating to knitting needle end cap configurations are Published U.S. Patent Application 2007/0245775 to Feldman-Abovitz (2007) which discloses an end cap with one or more holes usable to support decorative objects such as beads from metal wire, ribbons, or leather; U.S. Pat. No. 7,107,796 to Jost (2006) which discloses a knitting needle having a longitudinally-extending measuring scale and an end cap configured with a terminal concave area sized for use in perpendicular alignment with a second knitting needle to assist in the measurement of the width of a specified number of stitches and the length of a specified number of rows in gauge-testing knitted pieces and the length of a work-in-progress; and U.S. Design patent D271,062 to Okada (1993) which shows a striated single-point knitting needle with an end cap having an upright trapezoidal configuration when viewed from the side. No apparatus or method for knitting activity is known that functions in the same manner, has all of the same features and components, or provides all of the ergonomic, decorative, convenience, and other advantages of the present invention.

BRIEF SUMMARY OF THE INVENTION

It is the primary object of this invention to provide a hand-held tool that knitters can use to make the knitting process more comfortable and enjoyable. It is also an object of this invention to provide a hand-held tool for knitting that is more easily and comfortably held by knitters' fingers during new loop/stitch creation. Another object of this invention is to provide knitting needles with a more ergonomic configuration at least in the areas of its shaft generally held by knitters new loop/stitch creation and stitch/loop transfer. A further object of this invention is to provide a hand-held tool for easier and faster knitting by those having arthritic hands and/or joint problems in the fingers, hands, or wrists. It is also an object of this invention to provide a tool for extending the duration of comfortable knitting by decreasing finger and hand fatigue from the outset of use. In addition, it is an object of this invention to provide knitting needles with decorative enhancement that also provides ergonomic benefit.

The present invention, when properly made and used, provides a knitting needle (in the form of a single-point, double-point, or circular knitting needle) with one or more elevation changes (protrusions raised above the shaft's exterior surface, and/or depressions extending below the shaft's exterior surface) of sufficient size and structure to provide ergonomic benefit on at least the portion of a knitting needle shaft most frequently held by knitters during stitch/loop creation, to allow knitting with enhanced comfort, to promote faster knitting, and/or promote knitting for longer periods of time with less risk of fingers or hands becoming tired, numb, and/or aching from the repetitive motion inherent in knitting activity. The present invention elevation changes typically start at the proximal end of the tapering work area adjacent to each pointed end/tip associated with the shaft (or within approximately one to one-and-one-half inches thereof) and extends longitudinally along the shaft a minimum distance of approximately one-and-one-half to two inches. It also contemplated for the present invention elevation changes to extend laterally around the full perimeter dimension of a knitting needle shaft's exterior surface. Furthermore, since the stitches/loops created during knitting activity are moved from a donor shaft to a recipient shaft, and the matched knitting needle shafts in a set (single-point, double-point, or circular) take turns being a donor or recipient shaft, all such shafts in a set should have at least one present invention elevation change as described above to provide at least the minimum ergonomic benefit preferable to the knitters using them. In addition to the raised protrusion or protrusions used, the present invention ergonomic knitting needle may also have a non-circular cross-sectional configuration that is structured to provide ergonomic benefit, such as but not limited to that of a triangle with softened corners/edges. Since the easy sliding of stitches off of the pointed end/tip of a donor knitting needle onto a recipient knitting needle (or in the alternative onto the second pointed end/tip of a circular knitting needle) is important for enhanced knitting speed and even knitting tension, it is not contemplated for elevation changes or the non-circular cross-sectional configuration to extend as far as the pointed end/tip of present invention knitting needles or onto the tapering work area adjacent to the pointed end/tip. However, as an alternative, such areas may contain decorative markings that are configured to extend the visual appearance of any pattern established by elevation changes used on the shaft, or provide a decorative contrast to them. The decorative markings could be formed as a part of the knitting needle shaft during manufacture, or applied to the shaft in a separate manufacturing step (or even after manufacture). However, any applied decorative markings should be firmly associated with the shaft so as not to prematurely degrade or interfere with easy stitch/loop movement across the shaft. It should be noted that due to the small O.D. of some knitting needles (a standard size 4 needle has an O.D. of one-eighth of an inch), the elevation changes on a present invention knitting needle shaft may have a very small thickness dimension (even as small as approximately 0.0004 inches) or a thickness dimension close to the preferred maximum thickness of approximately four or five millimeters (usually anticipated for use on needles having a larger O.D.), which is beneficial to provide ergonomic benefit but not too large to interfere with the easy sliding of stitches/loops across the shaft. More than one size, shape, and/or thickness of raised protrusion may be used at once on a present invention knitting needle shaft, for decorative accent as well as ergonomic benefit, and the spacing between adjacent elevation changes on the same knitting needle may also vary, and/or be different from that on any other present invention knitting needle shaft (including a paired needle or others in a set of four double-point needles). Similarly, it is contemplated for the present invention knitting needles configured as a circular needle to have elevation changes extending substantially across each of the two rigid members (shortened shafts) that are employed for user gripping during knitting activity, but not extend onto the pointed ends/tips of the rigid members or the tapering work area adjacent thereto that is used to transfer stitches/loops from one rigid member to the other. However, although elevation changes similar to those used on the rigid members could also be used on the smaller-diameter flexible filament extending between the two rigid members, the filament portion of a circular needle is not typically held by knitters and there would be little benefit derived by applying elevation changes to it, other than for decorative purposes, such as but not limited to providing a decorative pattern extension of, or contrast to, the pattern or patterns established by elevation changes associated with the rigid members. The present invention knitting needles with ergonomic benefit would be made to have different length and diameter dimensions, including standard knitting needle sizes, so as to not require knitters to make any fundamental changes in knitting habits to achieve the gauge recommendations displayed in existing knitting pattern books and/or other printed knitting instructions. Furthermore, the present invention may also include a convenience-enhancing modification to the stitch-retaining end cap routinely used on the non-pointed end of a single-point knitting needle configuration, wherein a tube or post is added to the exterior surface of the end cap as a mounting projection (one that preferably extends away from the knitting needle shaft) to temporarily secure a resilient point protector in a convenient position close to the knitter while knitting activity occurs, with the point protector remaining readily accessible to the knitter so that it can be promptly placed over the pointed end of the knitting needle after knitting activity ceases, to prevent knitted stitches remaining on a needle from inadvertently traveling beyond the knitting needle's pointed end/tip while knitting activity is temporarily suspended.

The description herein provides preferred embodiments of the present invention but should not be construed as limiting its scope. For example, variations in the combinations of diameter dimension and length dimension used in the present invention knitting needle shafts; whether the elevation changes associated with each shaft are all the same size, shape, height, thickness, and/or depth dimension; whether all of the elevation changes associated with each shaft have uniform spacing from one another or random spacing; whether one elongated raised protrusion, groove, or channel in the form of a spiral or other configuration is used, or whether multiple elevation changes are employed; whether the elevation changes associated with each shaft have a contrasting color to that of the shaft and/or other color enhancement; whether needles in a pair or set (typically four) have matched or differing elevation changes, and the amount of space on the exterior surface of a present invention knitting needle shaft with no elevation changes (tapering or non-tapering) adjacent to the knitting needle's pointed end/tip that is available for new loop creation and ease in moving stitches/loops from one needle or rigid member to another, other than those shown and described herein, may be incorporated into the present invention. Thus, the scope of the present invention should be determined by the appended claims and their legal equivalents, rather than being limited to the examples given.

BRIEF DESCRIPTION OF THE SEVERAL VIEWS OF THE DRAWINGS

FIG. 14 is a rear view of the seventh preferred embodiment of the present invention that only reveals a substantially planar exterior surface that is possible on the terminal flange portion of the stitch-preserving end cap secured over the triangular non-pointed end of the knitting needle shaft, which although not shown may display markings that identify knitting needle size, manufacturer name and address information, an email address, and the like.

FIG. 19 is a perspective view of the preferred configuration of knitting needle shaft used in the tenth preferred embodiment of the present invention that transitions from triangular to circular on both of its ends, with its pointed end and end cap omitted to better reveal the circular cross-sectional configuration on its two ends and the triangular cross-sectional configuration in between.

COMPONENT LIST

Figure 1:
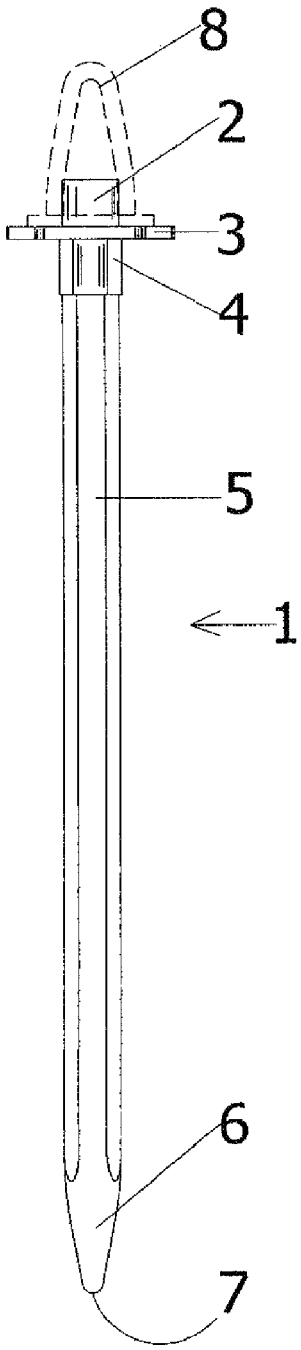
FIG. 1 is a side view of a first preferred embodiment of the present invention having the configuration of a single-point knitting needle, a shaft with a triangular cross-sectional configuration, and a point protector shown in broken lines secured upon a mounting projection extending outwardly beyond the flange of the end cap fixed over the non-pointed/non-working end of the triangular knitting needle shaft, with the end cap's flange having an anti-roll perimeter configuration also in the shape of a triangle

1—Single-point knitting needle providing ergonomic benefit to a knitter

2—Projection from end cap 4 or 11 that is configured to removably mount and indefinitely retain point protector 8 in a fixed position close to a knitter for easy accessibility (may be a tube or post, also may have a flat or convex distal end)

3—Flange with a non-circular anti-roll configuration that can be used with triangular end cap 4

4—Knitting needle end cap having a perimeter configuration substantially in the shape of a triangle

5—Non-circular knitting needle shaft configured to provide ergonomic benefit to knitters (may have triangular, hexagonal, octagonal, pentagonal, or other non-circular cross-sectional configuration that promotes uniform stitch/loop formation during stitch/loop transfer from a donor needle to a recipient needle)

6—Tapering work area adjacent to the pointed end/tip 7 of a present invention knitting needle (positioned between shafts 5 or 12 and pointed end/tip 7), or adjacent to the pointed end/tip 7 of a rigid member 25 or 26 (shortened shaft) of a circular knitting needle 23 or 24

7—Pointed end/tip that is used for new loop creation and stitch/loop transfer in present invention single-point knitting needles, present invention double-point knitting needles, and the rigid members (25, 26, or other) of present invention circular knitting needles

8—Prior art point protector used for covering a knitting needle's pointed end/tip 7 when knitting activity in a work-in-progress is temporarily suspended (during use on pointed end/tip 7 it provides stitch-preserving benefits and enhanced safety by decreasing the potential for injury from pointed end/tip)

9—Triangular cross-sectional configuration of shaft 5 (a triangle with softened or radiused corners is preferred, instead of one with sharp corners/angles)

10—Circular flange on end cap 11 (does not have the anti-roll configuration of the flange 3 shown on end cap 4)

11—End cap with circular perimeter configuration

12—Knitting needle shaft with a circular cross-sectional configuration

13—Elevation changes that are associated with the shaft 5 or 12 of a knitting needle and formed into a linear or spiral configuration structured to provide ergonomic (can be in the form of raised protrusions, depressions, grooves, or channels)

14—Small elevation changes that are associated with the shaft 5 or 12 of a knitting needle and positioned in rows and/or otherwise structured to provide ergonomic advantage (can be in the form of raised protrusions or depressions)

15—Large elevation changes that are associated with the shaft 5 or 12 of a knitting needle and positioned in a staggered configuration and/or otherwise structured to provide ergonomic advantage (can be in the form of raised protrusions or depressions)

16—Non-tapering area of knitting needle with a circular cross-sectional configuration (it can be positioned adjacent to tapering work area 6 to become an additional work area void of elevation changes that can assist in new loop creation and stitch/loop transfer, or it can be in an opposed position on a single-point knitting needle covered in part by end cap 11 and could be easily created when the central non-circular gripping area of shaft 5 is formed during manufacture by a crimping action applied to material in the form of a cylindrical rod, leaving material on both of the rod's ends in its original non-tapering configuration with a circular cross-section)

17—Ergonomic double-point knitting needle having non-circular cross-sectional configuration

18—Decorative pattern or pattern extension (it is not raised above the exterior surface of a knitting needle shaft 5, 12, or other, and does not form a depressed area below the exterior surface of a knitting needle shaft; it is used on the non-tapering work area 16 of a knitting needle, the tapering work area 6 adjacent to the knitting needle's pointed end/tip 7, and/or the pointed end/tip 7; and decorative pattern 18 may provide color accent contrast to the knitting needle shaft 5, 12, or other, or provide an independent design element)

19—Ergonomic double-point knitting needle having a circular cross-sectional configuration, elevation changes 20 on its shaft 12 between the two non-tapering additional work areas 16, and a decorative pattern 18 on each of its non-tapering additional work areas 16, each of its tapering work areas 6 adjacent to one of the double-point needle's pointed ends/tips 7, and each of its pointed ends/tips 7

20—Elevation changes in multiple sizes (those used on a single knitting needle shaft may have the same or differing length, width, height diameter and/or depth dimension; also tapering edges that do not impede movement of stitches/loops along shaft 5, 12, or other are preferred, and a minimum thickness dimension of approximately 0.0004 inches is also preferred)

21—Transition area extending from the triangular cross-section of shaft 5 to the circular cross-section of non-tapering area 16 (configured to allow the smooth and easy movement of knitted stitches/loops from shaft 5 to pointed end/tip 7)

22—Ergonomic single-point knitting needle having a non-tapering additional work area 16 with a circular cross-section adjacent to its tapering work area 6

23—Ergonomic circular knitting needle with a flexible member 27 extending between two rigid members 25 each having a circular cross-sectional configuration, grip-enhancing raised protrusions in a linear or spiral configuration 13 that provides ergonomic advantage on the portion of each rigid member 25 most likely to be held by knitters during stitch/loop transfer, a non-tapering void area 16 without elevation changes that provides an additional work area for stitch/loop creation between the elevation changes 13 and the tapering work area 6 adjacent to the pointed end/tip 7 at the working end of each rigid member 25

24—Ergonomic circular knitting needle with one of its rigid members 26 having a triangular cross-section and the opposed rigid member 25 having a circular cross-sectional configuration, small elevation changes in rows 14 that are configured to provide ergonomic advantage on the portion of each rigid member 25 and 26 most likely to be held by knitters during stitch/loop creation, a non-tapering void area 16 without elevation changes that provides an additional work area for new loop creation and stitch/loop transfer in a location between the elevation changes 14 and the tapering work areas 6 adjacent to the pointed tip 7 at the working end of each rigid member 25 and 26

25—Rigid member of circular knitting needles 23 and 24 having opposing tapered ends, a circular cross-sectional configuration, and a non-tapering void working area 16 without elevation changes that provides an additional work area for new loop creation and stitch/loop transfer between the elevation changes 13 or 14 and the tapering work area 6 adjacent to its stitch-transferring pointed end/tip 7

26—Rigid member of circular knitting needle 24 having a central triangular cross-sectional configuration, opposing tapered ends each with a circular cross-sectional configuration, a transition area 21 extending from the central triangular cross-section to the circular cross-section of each of its opposing tapered ends, and a non-tapering void working area 16 without elevation changes that provides an additional work area for new loop creation and stitch/loop transfer in a location between the elevation changes 14 and the tapering work area 6 adjacent to its stitch-transferring pointed end/tip 7

27—Flexible tubing/filament extending between the non-working ends of rigid members 25 and 26 of the circular knitting needles 23 and 24 (it may be reduced in diameter dimension as compared to rigid members 25 and 26; it is configured to carry stitches/loops back onto the non-working end of either rigid member 25 or 26 for additional stitch/loop transfer from pointed end/tip; it may or may not have elevation changes; and it is not held by knitters during stitch/loop transfer)

28—Single-point knitting needle having a shaft 5 providing a central ergonomic configuration via the use of a triangular cross-section with softened edges, a non-tapering area 16 of circular cross-sectional configuration near each of the ends of shaft 5, an end cap with a terminal flange 10 fixed to one of the non-tapering areas 16, and a tapering work area 6 between its stitch-transferring pointed end/tip 7 and the other of said non-tapering areas 16 which is positioned for use as an additional work area for new loop creation and stitch/loop transfer, and also with a transition area 21 between the triangular cross-section of shaft 5 and each non-tapering circular cross-section area 16 that is configured for smooth and easy movement of stitches/loops from shaft 5 to non-tapering areas 16.

DETAILED DESCRIPTION OF THE INVENTION

Knitting needles traditionally have a shaft with a circular cross-section and a smooth exterior surface, and come in standard sizes for predictability in the size of a finished product when printed knitting instructions are followed. They also may be in the form of a single-point needle having an elongated rigid shaft and a stitch-preserving end cap on its non-working (non-stitch-transferring) end, a double-point needle having an elongated rigid shaft and two working ends, or a circular knitting needle having two rigid members (shortened shafts) each with a pointed loop-transferring tip/end, with the two rigid members joined to one another via an elongated flexible filament generally of reduced diameter dimension. The knitting process is accomplished by using the pointed ends/tips 7 of the knitting needles to draw one or more new loops through a series of loops previously placed on a knitting needle shaft 5, involving one or more of the prior loops at a time, with twisting and other steps providing pattern variations in a work-in-progress The present invention's use of elevation changes at a minimum on the gripping area of a knitting needle shaft preferred by knitters during stitch/loop creation, which although slightly different for knitters using an overhand knife grip on a knitting needle shaft as opposed to an underhand pencil grip and also depending upon whether English or Continental knitting methods are used, is generally located near the tapering work area 6 close to the pointed end/tip 7 but no closer than approximately one-and-one-half to two inches from pointed end/tip 7, and sometimes as much as approximately two-and-one-half inches from pointed end/tip 7. Also, the minimum length dimension of the area over which it is contemplated for the present invention elevation changes to extend is approximately one-and-one-half inches, with the present invention elevation changes commonly having a longitudinal extension of approximately one-and-one-half to three inches, unless full coverage of a knitting needle shaft is desired for decorative purpose and/or manufacturing advantage. It is also contemplated for such elevation changes to extend completely around each present invention knitting needle shaft (5, 12, or other). However, the positioning of elevation changes in the present invention is not limited to the gripping area used during stitch/loop creation, and extending elevation changes along more of a knitting needle shaft (5, 12, or other) is also contemplated and considered to be within the scope of the present invention. Thus typically, although not limited thereto, the longitudinal extension of the elevation changes along a knitting needle shaft (5, 12, or other) would preferably be a minimum distance of approximately one-and-one-half inches (for providing ergonomic relief mainly to the thumb and opposed index and middle fingers which provide the primary support of all knitting needle shafts, including the shorter shafts of circular knitting needles) to approximately three inches (for also providing ergonomic relief to the ring and little fingers which supply supplemental support and balance for single-point and double-point knitting needle shafts during stitch/loop transfer to facilitate faster knitting). The elevation changes (13, 14, 15, or other) used as a part of the present invention are configured and positioned to alleviate problems relating to the repetitive nature of knitting activity, so that they create a multitude of spaces around the contact points that exist between a knitting needle shaft and the fingers and hands of the person holding it, wherein within such spaces little or no direct finger/hand contact with the shaft will take place. Elevation changes can be in the form of protrusions raised above the exterior surface of the knitting needle shaft (5, 12, or other) or in the form of a depression, groove, or channel that is carved out below the exterior surface of knitting needle shaft (5, 12, or other). Thus, each time the knitter stops stitch/loop creation to conduct an auxiliary knitting step, such as the advancement of stitches/loops toward the pointed end/tip 7 of a donor needle or away from the pointed end/tip 7 of a recipient knitting needle, an opportunity is provided for the knitter (either consciously or inadvertently) to re-grip the knitting needles in a manner that causes re-alignment of the spaces on the shaft with different areas of the knitter's fingers and hands, reversing any diminished circulation in the previous areas of hand/shaft contact that have now become aligned with a space, improving the opportunity for the knitter's fingers and hands to tire less rapidly when long periods of knitting are attempted. The auxiliary knitting steps providing relief to areas of diminished circulation in a knitter's hands and fingers are many, and include but are not limited to, the knitter stopping to review pattern accuracy, counting stitches, inspecting knitted loops, picking up a dropped loop, tying in a new strand, and reaching the end of a row, most of which occur repeatedly during knitting activity. Combining the elevation changes with a non-circular knitting needle shaft, provides additional ergonomic benefit and relief to knitters' hands and fingers. Thus, the present invention comprises a knitting needle shaft having a circular cross-sectional configuration with elevation changes, or elevation changes in combination with a non-circular knitting needle shaft, that in addition to providing a health benefit, also provides a comfortable fit of the knitting needle shaft in a knitter's hand, and further enhances a knitter's non-slip hold of the knitting needle shaft without changing the gauge of a work-in-progress or unduly stretching or deforming the loops thereon as they move along the shaft. Should a knitting needle only have one pointed end (single-point), the non-working end opposed to its pointed end/tip 7 typically has a stitch-preserving end cap secured over it that prevents any stitches on the needle's shaft from moving beyond the non-working end whether knitting activity occurs or not. Although not shown, the end caps of prior art knitting needles are traditionally disk-shaped and have a terminal flange with an exterior surface that is typically used for placement of informational markings relating to needle size and manufacturer identification. The present invention single-point knitting needle optionally includes an additional convenience for knitters via an end cap modification, wherein instead of having a terminal flange, the present invention end cap may have a tube or post extending outwardly from the flange away from the needle's shaft. Any post or tube so used is sized and otherwise configured to temporarily secure a conventional knitting needle point protector in a location convenient to a knitter while knitting activity occurs, so that it can be readily accessed for use over the pointed end/tip 7 of the knitting needle after knitting activity ceases, to prevent knitted stitches remaining on a needle from inadvertently traveling beyond the knitting needle's pointed end/tip 7 while knitting activity is temporarily suspended, and also to protect the knitter and others from inadvertent contact injury with the pointed end/tip 7 of a single-point needle. Although not shown, when a post is used, its top surface can be convex to further help its secure support of a point protector. Furthermore, the present invention is configured to provide ergonomic benefit when held in any orientation by left-handed and right-handed knitters alike, and it is not limited to only one manner of use, continuing to provide ergonomic benefit whether a knitter holds a knitting needle with an underhand pencil grip between the tips of the index finger and thumb with part of its shaft (5, 12, or other) resting on the middle finger and another portion of its shaft (5, 12, or other) resting against the hand close to the base of the index finger, whether a knitter holds a knitting needle with an overhand knife grip between the tip of the thumb a middle portion of the index finger and part of its shaft (5, 12, or other) resting between the other three fingers the hand, whether a knitter holds a knitting needle with a pencil grip variation where part of its shaft (5, 12, or other) is held by the tips of the thumb, index finger, and middle finger and another portion of its shaft (5, 12, or other) extends between the index finger and middle finger close to the base of each, or whether a knitter holds a knitting needle with any other grip variation. No knitting needles have been found, or are known, with elevation changes in combination with circular and non-circular shaft configurations that promote easier gripping and less fatigue for a knitter's fingers and hands, and solve an age-old discomfort problem faced by knitters. No other apparatus or method is known that functions in the same manner, provides all of the same features or structure, or provides all of the advantages of the present invention.

FIGS. 1-4 show a first preferred embodiment 1 of a present invention knitting needle configured and dimensioned to provide ergonomic benefit to a knitter (not shown) using it. FIG. 1 is a side view of first preferred embodiment 1 having a single-point knitting needle configuration and an elongated shaft 5 that has a triangular cross-sectional configuration 9 with softened edges (also see FIGS. 2 and 4 for additional understanding of contemplated cross-sectional configuration 9). FIG. 1 also shows a tapering work area 6 located between one of the opposing ends of shaft 5 and a pointed end/tip 7 (hereinafter substantially referred to as pointed end 7 without any intended limitation). Tapering work area 6 has a circular cross-sectional configuration 9 and is used by knitters for the transfer of loops onto or from shaft 5 via pointed end 7. FIG. 1 further shows the second end of elongated shaft 5 in a position opposed to and remote from pointed end 7. No pointed end 7 or tapering work area 6 is associated with the second end of elongated shaft 5. Instead, the second end of elongated shaft 5 has an end cap 4 securely fixed over it, with end cap 4 having the same triangular cross-sectional configuration 9 and softened edges as shaft 5. The means of securely fixing end cap 4 to the second end of elongated shaft 5 is not critical, and can be by any conventional means, including but not limited to force-fit attachment, crimping, and/or bonding agents. Furthermore, in place of a triangular cross-sectional configuration, should another embodiment of the present invention have a differing non-circular configuration, such as but not limited to that of a pentagon, it is contemplated for the end cap 4 used with it to have the same pentagonal cross-section that allows it to firmly fit over the non-working (non-stitch-transferring) end of shaft 5. FIG. 1 also shows end cap 4 having a flange 3 with an anti-roll triangular perimeter configuration (the triangular configuration is more easily observed in FIG. 4) and also configured with a mounting projection 2 that can be used to maintain a point protector 8 in close proximity to the knitter for prompt access when knitting activity is temporarily suspended and prompt placement on the tip/end 7 of a knitting needle shaft 5 to preserve the positioning of loops (not shown) thereon. A prior art point protector 8 and its hollow interior that would be used to cover mounting projection 2 during its association with shaft 5 is shown in FIG. 1 via broken lines. Although a triangular configuration is shown in FIG. 1 as one example of an anti-roll flange 3 configuration that can be used as a part of the present invention, the triangular configuration shown should be considered only as an example and not as a critical or limiting feature of the present invention. Thus, the anti-roll configuration of flange 3 could also be in the form of an octagon, hexagon, pentagon, or any other configuration that would be of benefit in preventing shaft 5 from moving significantly from the original location selected when it is lowered down onto a support surface (not shown).

Figure 2:
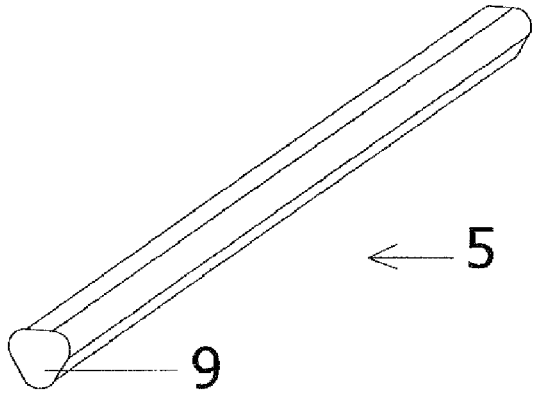
FIG. 2 is a perspective view of the preferred triangular configuration of knitting needle shaft used in the first preferred embodiment of the present invention with its pointed end and end cap omitted to better reveal the shape of the softened corners of the shaft's triangular cross-sectional configuration.
Figure 3:
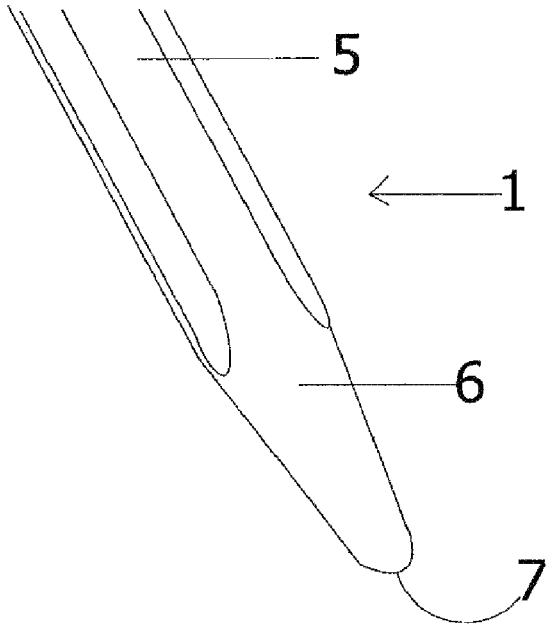
FIG. 3 is an enlarged view of the pointed end/of the first preferred embodiment of the present invention, the tapering work area positioned adjacent to the knitting needle's pointed end/tip, and the circular cross-sectional configuration of the tapering work area.
Figure 4:
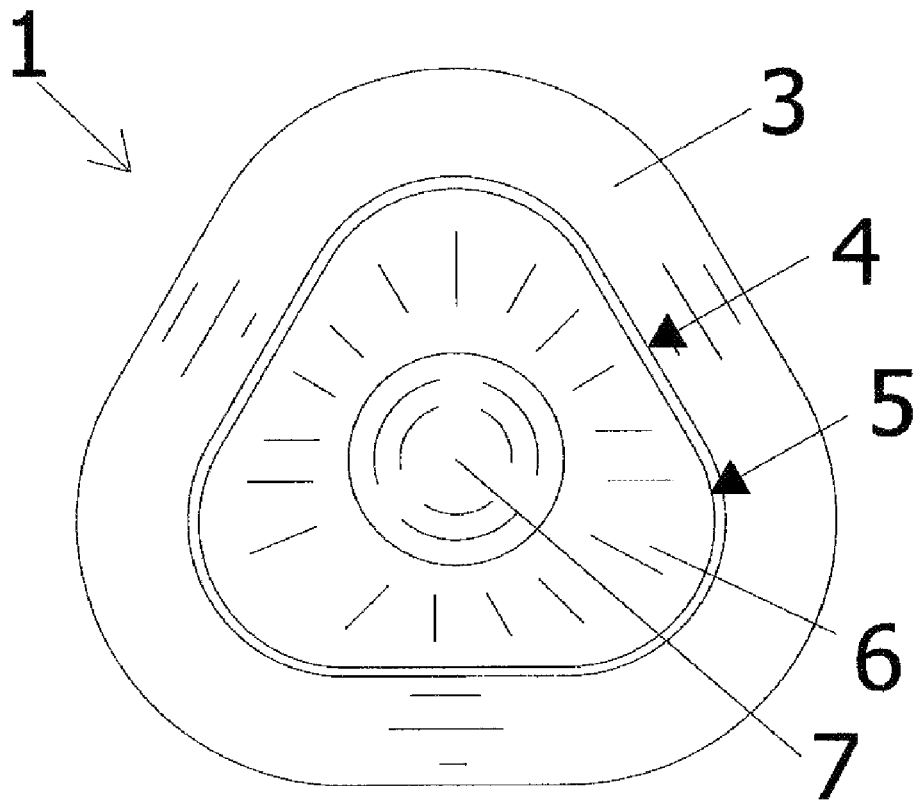
FIG. 4 is a front end view of the first preferred embodiment of the present invention showing its pointed end/tip positioned in front of its triangular shaft, the tapering work area extending between the pointed end/tip and the triangular shaft, and the triangular shaft positioned in front of the triangular-shaped flange of its end cap.

In contrast, FIG. 2 is a perspective view of the preferred configuration of knitting needle shaft 5 used in first preferred embodiment 1 with its pointed end 7 and end cap 4 omitted to better reveal its generally triangular cross-sectional configuration 9. For easiest use in prompt and smooth transfer of loops from one shaft 5 to another via pointed ends 7, it is preferred for the triangular corners/edges of shaft 5 to be softened or radiused, similar to that shown in FIGS. 1-3. However, although softened edges/corners are preferred, they are not considered critical to the present invention since elevation changes are also used, which would extend across at least some portions of an un-softened edge or corner and help to facilitate the prompt and smooth movement of loops onto and across shaft 5. Whatever the resulting configuration of a present invention shaft (5, 12, or other), including whether elevation changes are added (such as those in FIGS. 5-7 or other), provisions could (and most likely would) be made to approximate standard sizes of knitting needles so that gauge recommendations in printed patterns are important to a finished project, they can be easily achieved. Furthermore, FIG. 3 is an enlarged view of the pointed end 7 of first preferred embodiment 1 and the circular cross-sectional configuration of the tapering work area 6 adjacent to pointed end 7, while FIG. 4 is a front end view of first preferred embodiment 1 showing its pointed end 7 having a substantially circular cross-sectional configuration and being positioned in front of its associated triangular-shaped shaft 5, the tapering work area 6 extending between pointed end 7 and generally triangular-shaped shaft 5, and shaft 5 positioned in front of its generally triangular-shaped end cap 4 with its generally triangular-shaped flange 3. As can be best seen in FIGS. 1 and 4, the softened-corner triangular perimeter configuration of end cap 4 assists in providing it with a secure connection to the softened-corner triangular cross-sectional configuration 9 of shaft 5. It should be noted that FIGS. 1-4 are merely representative, and should not be used for measuring proportional dimensions of end cap 4, flange 3, mounting projection 2, shaft 5 and its triangular configuration 9, or tapering work area 6. Also, although not shown, a contemplated variation for first preferred embodiment 1 can include, but is not limited to, mounting projection 2 being in the form of a tube or a post, and when a post is used, having the top surface thereof either planar or raised centrally into a convex configuration. A further variation in mounting projection 2 could comprise a greater length than is shown in FIG. 1 and a configuration that more closely resembles the shape of the interior bore of point protector 8 or other point protector use, such as but not limited to, one with a more cylindrical configuration. However, common sense should be exercised so that the configuration of any point protector 8 used not be so large as to add unnecessary weight to preferred embodiment 1, or get in the way of knitting activity. The triangular cross-sectional configuration 9 of shaft 5, with the additional advantage of softened corners/edges, allow more variation in the grip configuration of the fingers and hands of a knitter (not shown) around shaft 5 than would be afforded by a shaft (12 or other) having a circular cross-sectional configuration, thus providing the knitter with more opportunities for repositioning hands and fingers so that contact areas between them and shaft 5 can be changed frequently and sufficiently to reduce the tendency of the knitter's fingers and hands to prematurely tire, become numb, or incur injury from the repetitive motion inherent in knitting activity. Variations of the first preferred embodiment 1 of a present invention knitting needle from that shown in FIGS. 1-4 to create additional preferred embodiments of the present invention could also include, but are not limited to, the addition to shaft 5 of one or more elevation changes (13, 14, 15, 20, or other) of any size, shape, or positioning that also provides additional ergonomic benefit to shaft 5; the addition of one or more elevation changes (13, 14, 15, 20, or other) of any size, shape, or positioning to end cap 4, flange 3, and/or mounting projection 2; the addition of one or more decorative markings 18 to tapering work area 6 and/or pointed end 7 that provide substantially flush decoration thereon; the addition of one or more decorative markings 18 to end cap 4, flange 3, and/or mounting projection 2; a longer mounting projection 2 than is shown in FIG. 1; and providing tapering work area 6 with a tapering configuration more elongated than that shown in FIGS. 1 and 3. Furthermore, the areas of raised protrusions and/or depressions on each end of a double point knitting needle shaft (5, 12, or other) can be distinct from the other, or additional elevation changes (and/or non-raised pattern extensions) can be positioned between them as a pattern and/or color extension, or as a design and/or color contrast. In addition, since knitters release and re-grip knitting needles many times as a work-in-progress develops, and also since knitting progress would be slowed if a single orientation of a knitting needle shaft was required relative to a knitter's hand, it is contemplated for the present invention elevation changes to extend a full 360-degrees around the exterior surface of a present invention knitting needle shaft (5, 12, or other), whether it has a circular or other cross-sectional configuration. Also, to provide maximum ergonomic benefit to both hands of a knitter, it is preferred that all matched knitting needle shafts in a set of present invention knitting needles (whether single-point, double-point, or circular) have at least one elevation change (same or different from that on the other needles in the set), so that the function of any shaft may be readily changed from that of a donor shaft to that of a recipient shaft at any time required by written knitting instructions, without a knitter having to take the time manually transfer all stitches on one knitting needle to a different one. The positioning of raised protrusions, depressions, or combinations thereof, on each present invention shaft should at least be that portion of the shaft held during new loop creation against the knitter's thumb, that portion held during new loop creation against the tips of the knitter's middle and ring fingers, and that held during new loop creation against any opposing parts of the knitter's hand, for it is the knitter's thumb, middle finger, ring finger, and parts of the knitter's hand opposed thereto that provide the major support for the knitting needle shaft (5, 12, or other) and the portion of the work-in-progress suspended above the knitter's lap, and are substantially immobile while performing that function. In contrast, the positioning of elevation changes in the area of potential contact between a present invention knitting needle shaft and a knitter's index finger is of less concern, as the knitter's index fingers have less load-bearing responsibility, instead being active and mobile while assisting in new loop creation and stitch/loop transfer. Thus, present invention elevation changes make its shafts more functional for knitters to hold and thereby facilitate knitting activity by providing enhanced comfort for the knitter's fingers and hands, faster knitting, and/or knitting for longer periods of time with less risk of fingertips, hands, and forearms becoming tired, numb, and/or aching. Furthermore, even though the raised protrusions and/or depressions associated with a present invention knitting needle shaft are not made from resilient material, in addition to their ergonomic benefit, they will provide at least some grip-enhancing benefit for knitters. Use of present invention knitting needle modifications helps knitters needing large diameter knitting needles due to the greater amount of exterior surface area in contact with the knitter's hands and fingers, but will also assist knitters needing to use small diameter knitting needles, which are more difficult to hold and require a greater amount of pressure applied by the knitter's fingers and hands.

Figure 5:
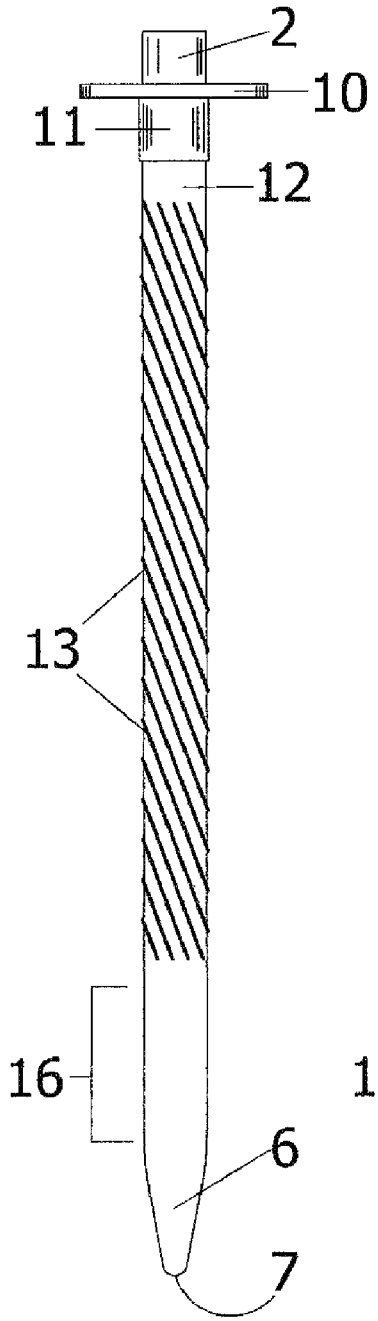
FIG. 5 is a side view of a second preferred embodiment of the present invention having a shaft with a circular cross-sectional configuration, elevation changes in a linear or spiral configuration that are structured to provide ergonomic advantage at a minimum on the portion of the shaft most likely to be held by knitters during stitch/loop creation, a tapering work area without elevation changes adjacent to the pointed tip at the working end of the knitting needle used to transfer loops on and off the shaft, a non-tapering void area with a circular cross-sectional configuration and no elevation changes that can become an additional work area for knitting activity between the elevation changes and the tapering work area, and an end cap with a mounting projection that extends away from the shaft and is configured to temporarily secure a point protector within easy reach of a knitter using the shaft, with the end cap and its flange each having a circular cross-sectional configuration.
Figure 6:
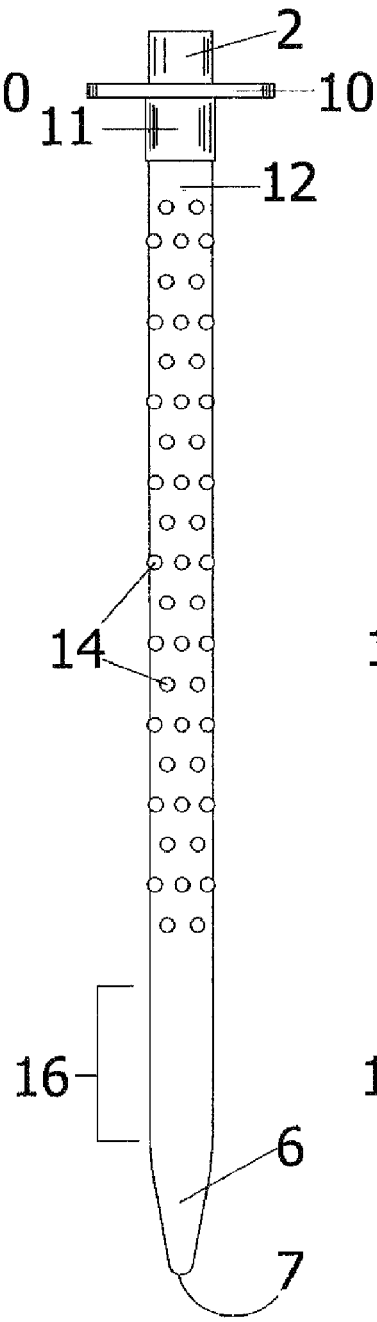
FIG. 6 is a side view of a third preferred embodiment of the present invention having a shaft with a circular cross-sectional configuration, small elevation changes in substantially evenly spaced apart rows that are structured to provide ergonomic advantage at a minimum on the portion of the shaft most likely to be held by knitters during stitch/loop creation, a tapering work area without elevation changes adjacent to the pointed tip at the working end of the knitting needle used to transfer loops on and off the shaft, a non-tapering void area with a circular cross-sectional configuration and no elevation changes that can become an additional work area for knitting activity between the elevation changes and the tapering work area, and an end cap with a mounting projection that extends away from the shaft and is configured to temporarily secure a point protector within easy reach of a knitter using the shaft, with the end cap and its flange each having a circular cross-sectional configuration.
Figure 7:
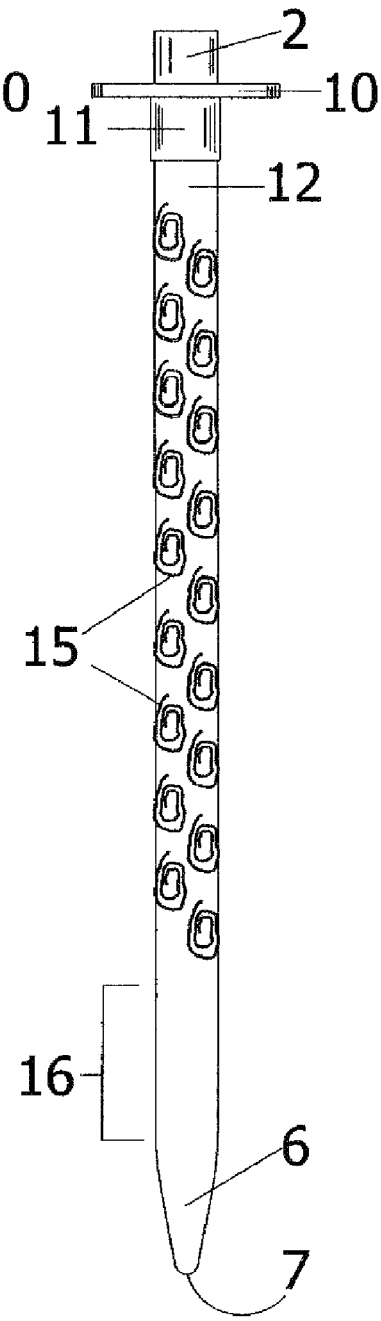
FIG. 7 is a side view of a fourth preferred embodiment of the present invention having a shaft with a circular cross-sectional configuration, large elevation changes in a staggered configuration that are structured to provide ergonomic advantage at a minimum on the portion of the shaft most likely to be held by knitters during stitch/loop creation, a tapering work area without elevation changes adjacent to the pointed tip at the working end of the knitting needle used to transfer loops on and off the shaft, a non-tapering void area with a circular cross-sectional configuration and no elevation changes that can become an additional work area for knitting activity between the elevation changes and the tapering work area, and an end cap with a mounting projection that extends away from the shaft and is configured to temporarily secure a point protector within easy reach of a knitter using the shaft, with the end cap and its flange each having a circular cross-sectional configuration.

While FIGS. 1-4 show a first preferred embodiment 1 of present invention knitting needle having a shaft 5 with a non-circular cross-sectional configuration that can be used with elevation changes (such as 13, 14, 15, or other) to provide enhanced ergonomic benefit to knitters, in contrast, FIGS. 5-7 each show a single-point knitting needle in the present invention having a shaft 12 with circular cross-sectional configuration and elevation changes respectively marked with the numbers 13, 14, and 15 that interrupt surface contact of a knitter's fingers and hand against the otherwise smooth exterior surface of circular shaft 12 to keep the knitter's hand, fingers, and forearms from prematurely becoming tired and experiencing discomfort during knitting activity. Elevation changes (such as 13, 14, 15, or other) cannot comprise resilient materials, or they would be likely to inhibit the easy movement of loops across shaft 12. Difficult movement of loops across shaft 12 not only places more pressure on a knitter's fingers during auxiliary knitting activity, it is also likely to have an adverse impact loop tension and adversely affect the finished appearance of work-in-progress. FIGS. 5-7 also show shaft 12 having an end cap 11 with a circular cross-sectional configuration configured for secure connection to circular shaft 12, and a flange 10 associated with end cap 11 that also has a circular perimeter configuration. FIGS. 5-7 also each show end cap 11 having a mounting projection 2 extending beyond flange 10 and configured for supporting a prior art point protector (an example of which is shown in FIG. 1 and identified by the number 8), with the single-point needles in FIGS. 5-7 each also having a elevation changes 13, 14, and 15 that, although different from one another, each provide ergonomic advantage on the portion of its circular shaft 12 near its pointed end 7 that is considered most likely to be held by knitters (not shown) during stitch/loop creation, whether a knitter is right-handed or left-handed, and also whether a knitter holds shaft 12 with an overhand or underhand grasp (also can be referred to respectively as knife and pencil grips). In addition, FIGS. 5-7 all show a tapering work area 6 adjacent to the loop-transferring pointed end 7, none having elevation changes 13, 14, and 15, and a circular cross-section non-tapering area 16 between elevation changes 13, 14, or 15 and tapering work area 6, with non-tapering areas 16 also being void of elevation changes 13, 14, and 15 so that they can become an additional work area for new loop creation and stitch/loop transfer according to knitter preference or application need. The use of non-tapering areas 16 can also assist the knitter in achieving the recommended gauge for a pattern used to make clothing, so that the finished clothing is true-to-size. Although not limited thereto, it is preferred for non-tapering additional work areas 16 to have a minimum length dimension of approximately one inch and a maximum length dimension of approximately one-and-one-half inches, as placing elevation changes (13, 14, 15, and other) closer to pointed end 7 than a distance of approximately one-and-one-half to two inches would be likely to interfere with purling activity and/or the accumulation of stitches needed to make a cable cross-over step or for the creation of other more complex patterns involving multiple stitches/loops, and therefore is not preferred. Furthermore, although not identifiable in FIGS. 5-7, it is also preferred for elevation changes (13, 14, 15, and other) to have a minimum thickness or depth dimension of approximately 0.0004 inches and a maximum thickness or depth dimension at the point where ergonomic benefit, comfort, and/or easy movement of loops along the knitting needle shaft 12 are no longer provided, generally determined by the inventor herein to be approximately 4 or 5 millimeters, but not limited thereto in all contemplated applications. FIG. 5 is a side view of a second preferred embodiment (no separate number assigned) of the present invention having a shaft 12 with a circular cross-sectional configuration, an elevation change 13 in a linear or spiral configuration that provides ergonomic advantage at a minimum on the portion of shaft 5 most likely to be held by knitters during stitch/loop transfer to or from shaft 12 via pointed end 7, a circular cross-section non-tapering work area 16 void of elevation changes (13, 14, 15, or other) that is located between the elevation changes 13 and the tapering work area 6 adjacent to the pointed tip 7 at the working end of the knitting needle, and an end cap 11 with a mounting projection 2 that extends away from shaft 12 and is configured to temporarily secure the point protector 8 in FIG. 1 (or other prior art point protector) in a fixed position in close proximity to the knitter holding shaft 12 for easy retrieval and use, with the end cap 11 and its flange 10 each having a circular cross-sectional configuration. The elevation changes 13 shown in FIG. 5 can either be raised protrusions that extend above the exterior surface of shaft 12, or in the alternative the lines in FIG. 5 marked by the number 13 can be the exterior surface of shaft 12 with the spaces in between being in the form of a channel or groove. A mixture of raised protrusions and depressions, channels, or grooves is also contemplated and considered to be within the scope of the present invention. In contrast, FIG. 6 is a side view of a third preferred embodiment (no separate number assigned) of the present invention having a shaft 12 with a circular cross-sectional configuration, small elevation changes 14 in rows that provide ergonomic advantage on the portion of the shaft 12 most likely to be held by knitters (not shown) during stitch/loop transfer to or from shaft 12 via pointed end 7, a circular cross-section non-tapering additional work area 16 without elevation changes (13, 14, 15, or other) located between the elevation changes and the tapering work area 6 adjacent to the pointed tip 7 at the working end of the knitting needle, and an end cap 11 with a mounting projection 2 that extends away from shaft 12 and is configured to temporarily secure the point protector 8 in FIG. 1(*or* other prior art point protector) in a fixed position in close proximity to knitters, with the end cap 11 and its flange 10 each having a circular cross-sectional configuration. The elevation changes 14 shown in FIG. 6 can either be raised protrusions that extend above the exterior surface of shaft 12, or in the alternative they can be a depression extending below the exterior surface of shaft 12. One possible interpretation of the small circles 14 shown as elevation changes in FIG. 6 is for each row of three circles 14 to represent protrusions raised above the exterior surface of shaft 12 and each row of two circles 14 to represent depressions extending below the exterior surface of shaft 12. Furthermore, FIG. 7 is a side view of a fourth preferred embodiment (no separate number assigned) of the present invention having a shaft 12 with a circular cross-sectional configuration, large elevation changes 15 in a staggered configuration that provide ergonomic advantage on the portion of shaft 12 most likely to be held by knitters (not shown) during stitch/loop transfer to or from shaft 12 via pointed end 7, a circular cross-section non-tapering additional work area 16 without elevation changes (13, 14, 15, or other) that is located between the elevation changes 15 and the tapering work area 6 adjacent to the pointed tip 7 at the working end of the knitting needle, and an end cap 11 with a mounting projection 2 that extends away from shaft 12 and is configured to temporarily secure the point protector 8 in FIG. 1 (or other point protector) in a fixed position in close proximity to knitters, with the end cap 11 and its flange 10 each having a circular cross-sectional configuration. The elevation changes 15 shown in FIG. 7 can either be raised protrusions that extend above the exterior surface of shaft 12, or in the alternative one or more elevation changes 15 can be a depression extending below the exterior surface of shaft 12. If the elevation changes 15 shown in FIG. 7 are a mixture of raised protrusions, depressions, channels, and/or grooves, the patterns for their placement can be random or structured, as long as the ergonomic advantage contemplated for knitters by the present invention is provided. The elevation changes 13, 14, and 15, shown are merely representative of several types of elevation changes that can be used as a part of the present invention and are not intended to illustrate the full scope of elevation changes possible in the present invention. As mentioned previously, the elevation changes (13, 14, 15, or other) of the present invention can be large, small, varied in size and/or thickness dimension, varied in thickness or depth, varied in spacing from one another, exhibit uniform spacing, extend only in the most likely gripping area for knitters on shaft 12 (or shaft 5, or another present invention shaft with a different cross-sectional configuration) during stitch/loop transfer, or extend substantially the full length of shaft 12 (5, or other). In addition, elevation changes (13, 14, 15, and other) can be shaped as regular polygons, abstract configurations, butterflies, flowers, hearts, lady bugs, artistic renditions of one or more recognizable people or objects, or an elongated line or combination of lines in a spiral or other configuration. However, elevation changes (13, 14, 15, and other) should have no sharp edges to snag loops as they are moved across shaft 12 (5, or other), and raised protrusions may have a convex configuration to avoid interference with loop movement across shaft 12 (5, or other). Another design consideration in the present invention to prevent the adverse stretching of stitches/loops as they are moved along shaft (5, 12 or other), is for the elevation changes (13, 14, 15, or other) used to have a longitudinally-tapering construction. When circular cross-section non-tapering additional work area 16 is present, it is typically void of elevation changes (13, 14, 15, or other), yet decorative markings 18 (see FIG. 10) could be optionally used on additional work area 16, as long as they would be substantially flush with its exterior surface and configured to not interfere with any stitch/loop accumulation steps, twisting, or other knitting activity preliminary to the transfer of loops (not shown) from pointed end 7. Although not shown in the accompanying illustrations, the presence of elevation changes (13, 14, 15, or other), or non-elevation changes (18 or other), could also be added to end cap 11, flange 10, and/or mounting projection 2 for decorative enhancement. However, since end cap 11, flange 10, and mounting projection 2 are not typically held by the user's hands during the transfer of stitches/loops to and from the present invention shaft (5, 12, or other), no ergonomic benefit is anticipated or identified by any such addition. Variations of the second, third, and fourth preferred embodiments of present invention knitting needle from that shown in FIGS. 5-7 to create new preferred embodiments of the present invention could also include, but are not limited to, the addition to shaft 12 of additional elevation changes (13, 14, 15, 20, or other) of any size, shape, or positioning that enhances the ergonomic benefit of shaft 12; substitution of elevation changes having any size, shape, or positioning that enhances the ergonomic benefit of shaft 12 for the elevation changes (13, 14, 15) shown on shaft 12; the addition of one or more elevation changes (13, 14, 15, 20, or other) of any size, shape, or positioning to end cap 11, flange 10, and/or mounting projection 2; the addition of one or more decorative markings 18 to tapering work area 6, non-tapering area 16, and/or pointed end 7; the addition of one or more decorative markings 18 to end cap 11, flange 10, and/or mounting projection 2; a longer mounting projection 2 than is shown in FIGS. 5-7; and providing tapering work area 6 with a tapering configuration more elongated than that shown in FIGS. 5-7. Also, present invention elevation changes would preferably start either at the proximal end of the tapering work area 6 adjacent to each pointed end/tip 7, or within approximately one to one-and-one-half inches thereof, and continue away from the pointed end/tip 7 through a minimum distance of approximately one-and-one-half to two inches. It is expected for the tapering work area 6 in present invention shafts (5, 12, or other) having a larger diameter dimension to be larger than the tapering work area 6 on a smaller present invention knitting needle. For example, the tapering work area 6 in a size "10" knitting needle may be expected to have a length dimension of approximately one inch, with the tapering work area 6 in a size "0" knitting needle being expected to have a length dimension of approximately one-fourth of an inch. However, elevation changes that consist of depressions and/or raised protrusions having a very small thickness dimension that does not impede stitch/loop transfer, or adversely affect knitting tension, would be able to extend across the tapering work area 6 and the pointed tip/end 7.

Figure 8:
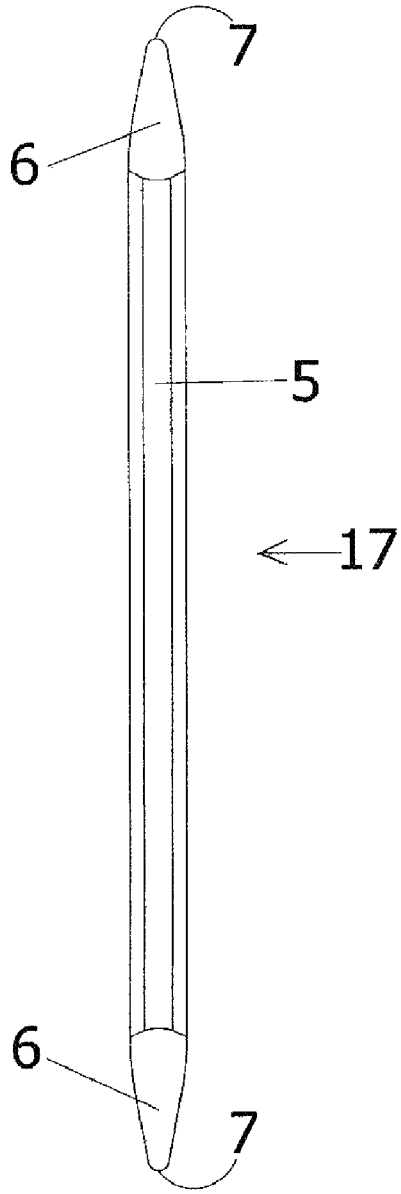
FIG. 8 is a side view of a fifth preferred embodiment of the present invention having the configuration of a double-point knitting needle with a shaft displaying a triangular cross-sectional configuration with softened corners/edges configured to provide ergonomic benefit, and also with the triangular cross-sectional configuration not extending into either of the two tapering work areas shown adjacent to the pointed ends/tips of the shaft.
Figure 9:
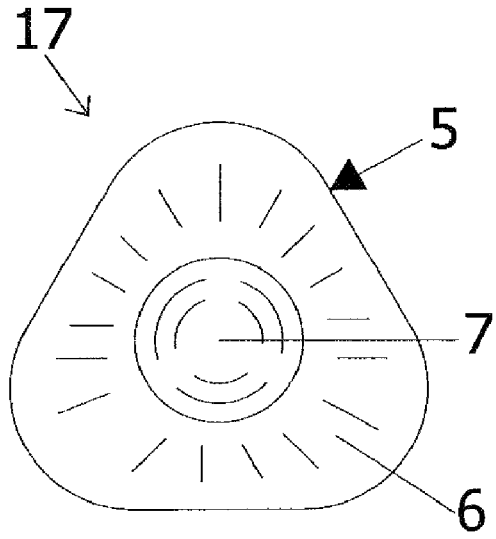
FIG. 9 is a front end view of the fifth preferred embodiment of the present invention showing its pointed end/tip positioned in front of its triangular shaft, and the tapering work area extending between the pointed end/tip and the triangular shaft.
Figure 10:
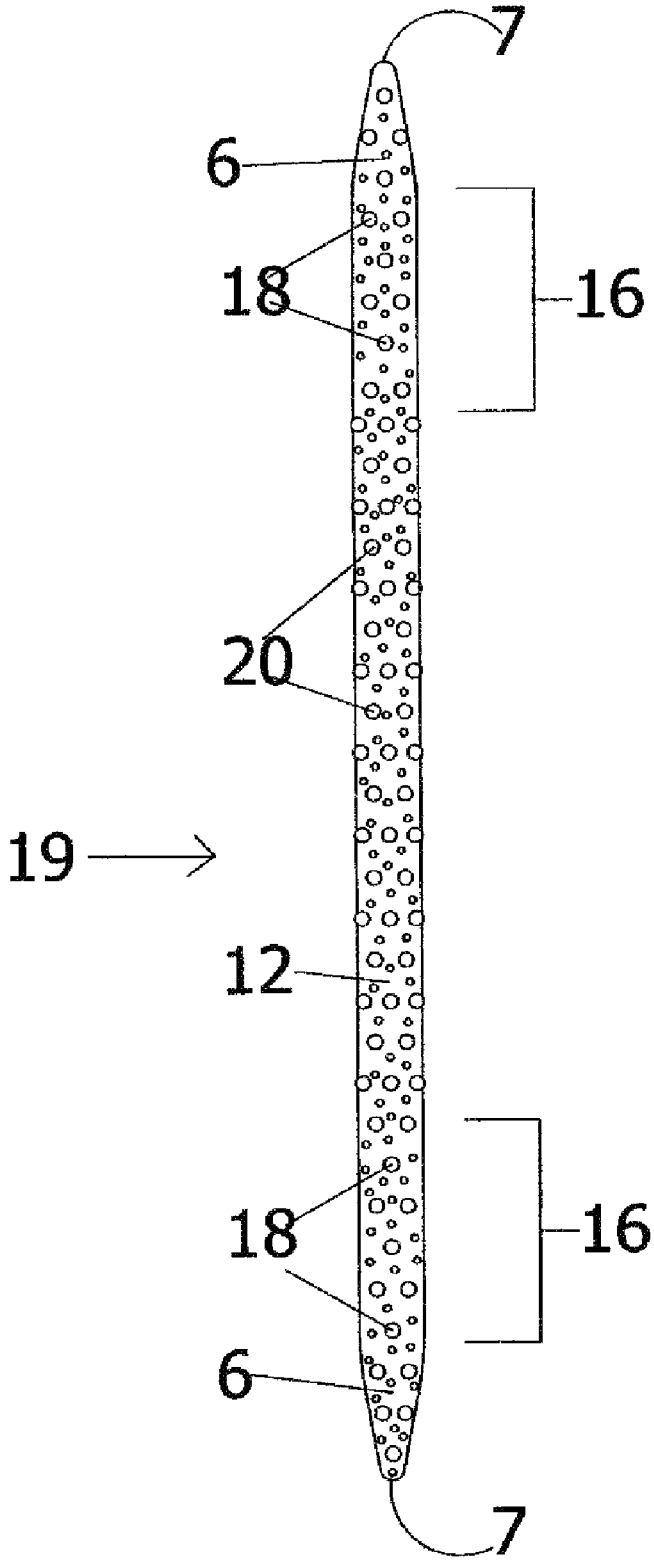
FIG. 10 is a side view of a sixth preferred embodiment of the present invention having the configuration of a double-point knitting needle with a shaft having a circular cross-sectional configuration, elevation changes centrally on the knitting needle's shaft having varied size and/or thickness dimension that are configured to provide ergonomic advantage, and decorative markings similar in appearance to the decorative enhancement provided by the elevation changes, with the decorative markings positioned on both of the pointed ends/tips, on both of the opposed tapering work areas adjacent to each pointed end/tip that are used for stitch/loop transfer, and on the two non-tapering portions of the double-point needle between the elevation changes and each tapering work area that can become additional work areas helpful when attempting more complex pattern stitches or which can be used to expedite the knitting process and promote even stitch tension by providing an area for temporary loop accumulation immediately prior to and after the transfer of stitches/loops from one needle to another that is able to delay the time interval between interruptions where the knitter typically spreads out newly transferred stitches on the recipient needle and crowds together on the donor needle the next group of stitches needing transfer to the recipient needle.

FIGS. 8-10 show fifth and sixth preferred embodiments 17 and 19 in the form of double-point needles that are considered to be within the scope of the present invention. FIGS. 8-9 show a double-point needle in the fifth preferred embodiment 17 of the present invention with a shaft 5 having a triangular cross-sectional configuration with softened edges/corners similar to the shaft 5 shown in FIG. 1, while FIG. 10 shows a double-point needle having a circular cross-sectional configuration and elevation changes 20 of varied size (and perhaps also varied thickness) associated with the exterior surface of its shaft 12. FIG. 10 also shows non-raised decorative markings 18 on each non-tapering additional work area 16, each tapering work area 6, and each pointed end 7. The definition of the word "non-raised" in this context is that decorative markings 18 are substantially flush with exterior portions of shaft 12 so as to cause no interference with the prompt and easy transfer of stitches/loops from a donor knitting needle to a recipient knitting needle. FIG. 8 is a side view of the fifth preferred embodiment 17 having the configuration of a double-point knitting needle with a triangular cross-sectional configuration, while FIG. 9 is a front end view of the fifth preferred embodiment 17 showing its circular pointed end 7 positioned in front of its generally triangular-shaped shaft 5, and the tapering work area 6 extending between pointed end 7 and shaft 5. FIG. 10 is a side view of the sixth preferred embodiment 18 having the configuration of a double-point knitting needle with a circular cross-sectional configuration, varied sizes and thicknesses of elevation changes 20 centrally on the knitting needle's circular shaft 12 that provide ergonomic advantage, and decorative markings 18 similar in style and spacing to the decorative enhancement provided by the elevation changes 20, with the decorative markings 18 positioned on both of the needle's pointed ends 7, both of the tapering work areas 6, and each of the circular cross-section non-tapering additional work areas 16 that are used for easy loop movement and accumulation near pointed end 7, as well as to aid the knitter in achieving pattern and gauge accuracy. The decorative markings 18 in FIG. 10 merely show an example of how decorative markings 18 in the preferred embodiments can appear as a pattern extension, but their appearance and/or spacing may also be contrasting and should not be considered as a limiting feature of the present invention. Decorative markings 18 can be printed on or stamped into shaft 12 as a pattern continuation as long as they remain substantially flush with the exterior surface of shaft 12 (5 or other) so as to be durable for long-term use and not interfere with fast and efficient stitch/loop transfer, and decorative markings 18 may also extend to pointed end 7, although doing so is not critical. Although FIG. 10 shows elevation changes 20 and decorative markings 18 having a circular configuration, it is not contemplated for either to be limited to the circular configuration shown. The intent is merely that elevation changes 20 or other not have shape edges that could interfere with fast and efficient stitch/loop transfer. Furthermore, although FIG. 10 shows elevation changes 20 extending completely between the two non-tapering additional work areas 16, the central-most portion (perhaps as much as several inches) of the shaft 12 shown in FIG. 10 could be void of elevation changes 20, as long as sufficient elevation changes 20 were present in the areas adjacent to the two non-tapering additional work areas 16 where it would be most likely for knitters to grasp shaft 12 during stitch/loop creation and transfer By way of further example as to the composition of elevation changes 20 or other, they may also include, but are not limited to, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, multiple elevation changes at least two of which have different depth dimensions, and elevation changes having a minimum thickness dimension of approximately 0.0004 inches. Variations of the sixth and seventh preferred embodiments (respectively identified by the numbers 17 and 19) of a present invention knitting needle from that shown in FIGS. 8-10 to create new preferred embodiments of the present invention could also include, but are not limited to, the addition to shafts 5 or 12 of one or more elevation changes (13, 14, 15, or other) of any size, shape, or positioning that also provides additional ergonomic to shafts 5 or 12; and providing tapering work area 6 with a tapering configuration more elongated than that shown in FIGS. 8 and 10.

Figure 11:
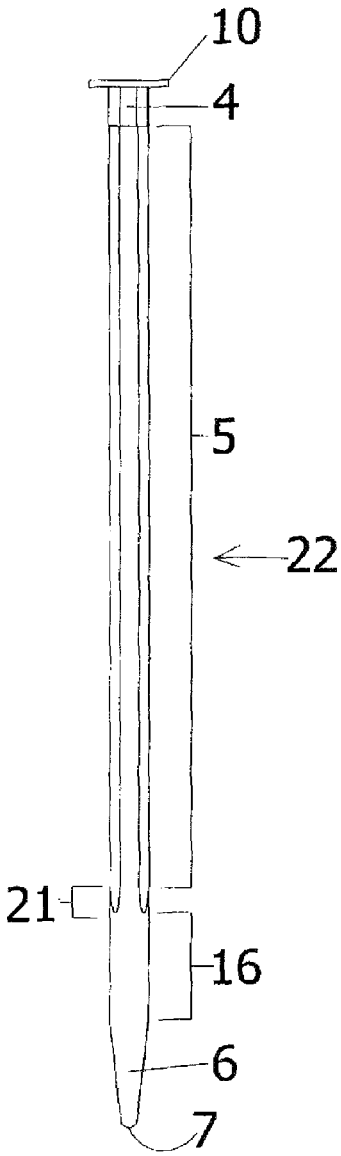
FIG. 11 is a side view of a seventh preferred embodiment of the present invention having the configuration of a single-point knitting needle with a shaft having a triangular cross-sectional configuration that transitions into a non-tapering additional work area having a circular cross-section, with the single-point needle further having a tapering work area positioned between the non-tapering additional work area and the knitting needle's pointed end/tip, and also having an end cap with no mounting projection, a triangular cross-sectional configuration, and a terminal flange with circular perimeter configuration.
Figure 12:
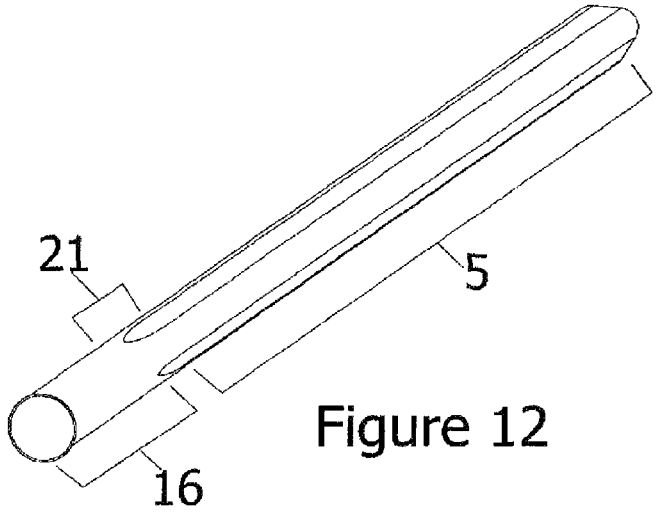
FIG. 12 is a perspective view of the preferred configuration of knitting needle shaft used in the seventh preferred embodiment of the present invention that transitions from triangular to circular on one of its ends, with its pointed end and end cap omitted to better reveal the circular cross-sectional configuration on one of its opposing ends and the triangular cross-sectional configuration on the other of its opposing ends.
Figure 13:
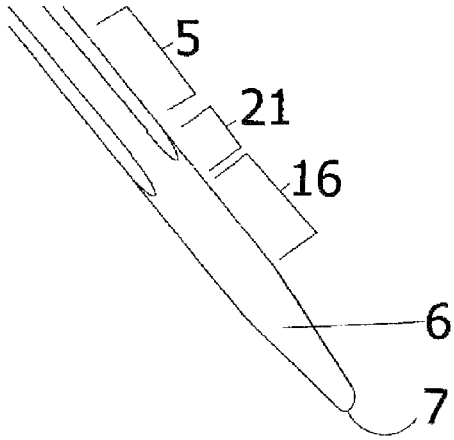
FIG. 13 is an enlarged view of the pointed tip of the seventh preferred embodiment of the present invention, the triangular cross-sectional configuration of the knitting needle's shaft with softened corners/edges, the tapering work area adjacent to the knitting needle end/tip, the circular cross-sectional configuration of the non-tapering additional work area adjacent to the tapering work area, with the transition area between the non-tapering additional working area and the triangular shaft also identified.
Figure 14:
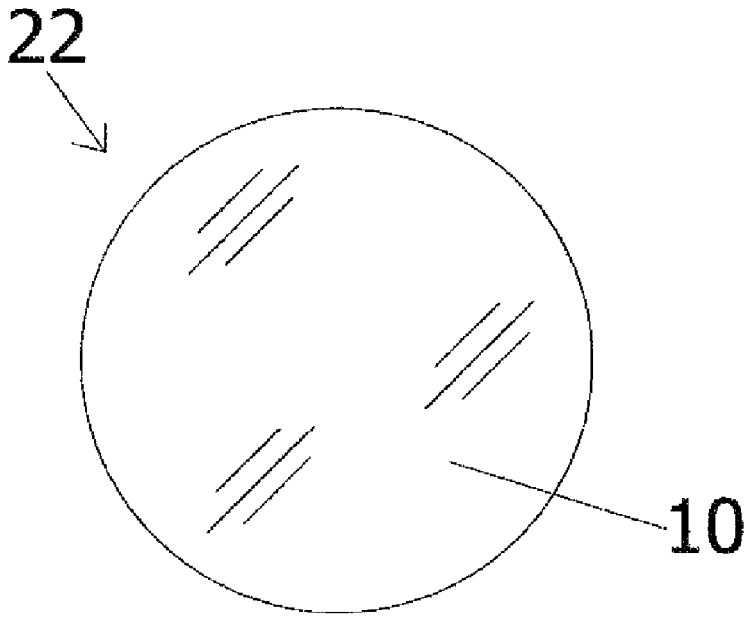
Figure 15:
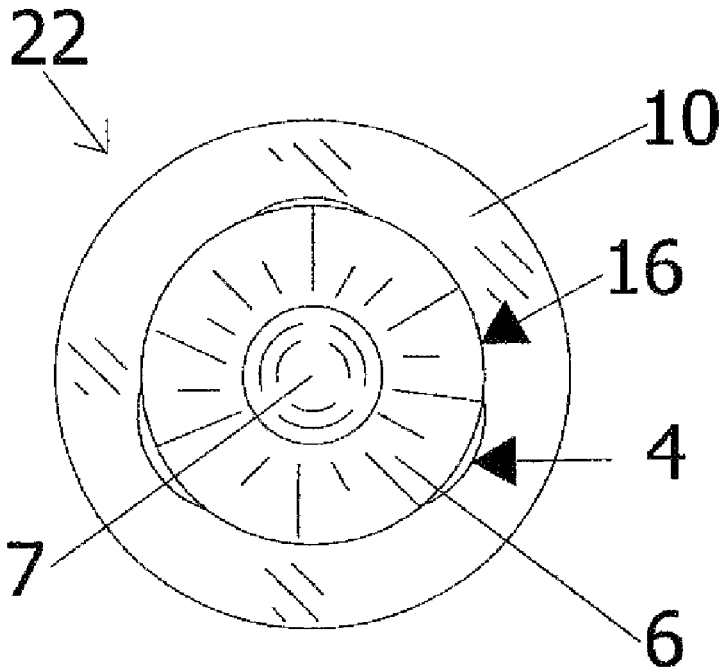
FIG. 15 is a front end view of the seventh preferred embodiment of the present invention showing its pointed end/tip positioned in front of its triangular-shaped shaft, the tapering work area extending between the pointed end/tip and the triangular shaft, and the triangular shaft positioned in front of its triangular-shaped end cap, with the terminal flange of the triangular end cap having a circular perimeter configuration.

FIGS. 11-15 show a seventh preferred embodiment 22 of a single-point knitting needle considered within the scope of the present invention, which is similar to that shown in FIG. 1. Its shaft 5 has a triangular cross-sectional configuration and softened corners/edges, but instead of having a triangular cross-sectional configuration that extends all of the way to its tapering work area 6, the single-point knitting needle 22 in FIGS. 11-15 has a non-tapering additional work area 16 with a circular cross-sectional configuration adjacent to tapering work area 6, as well as a transition area 21 between additional work area 16 and the triangular cross-sectional configuration of its shaft 5. Transition area 21 is configured to allow prompt, smooth, and easy movement of loops onto and from shaft 5 during stitch/loop transfer and as needed during other knitting activity (and/or auxiliary knitting activity). FIG. 11 is a side view of the seventh preferred embodiment 22 having the configuration of a single-point knitting needle with a shaft 5 having a triangular cross-sectional configuration that transitions (via transition area 21) into a circular cross-section in the additional working area 16 adjacent to the tapering work area 6 and pointed end 7. FIG. 11 also shows its end cap 4 having a triangular cross-sectional configuration, and a terminal flange 10 with a circular perimeter configuration and no mounting projection. In contrast, FIG. 12 is a perspective view of the preferred configuration of knitting needle shaft 5 used in the seventh preferred embodiment of the present invention that transitions (via transition area 21) from triangular into a circular cross-section in the additional working area 16, with its pointed end 7 and end cap 4 omitted to better reveal the circular cross-sectional configuration on one of its opposing ends (part of additional work area 16) and the triangular cross-sectional configuration on the other of its opposing ends (part of shaft 5). In addition, FIG. 13 is an enlarged view of the pointed end 7 of the seventh preferred embodiment 22 and shows the triangular cross-sectional configuration of its shaft 5, the tapering work area 6 adjacent to its pointed end 7, the circular cross-sectional configuration of the additional work area 16 adjacent to the tapering work area 16, and the transition area 21 located between the additional working area 16 and the triangular shaft 5. In contrast, FIG. 14 is a rear view of the seventh preferred embodiment 22 that only reveals a substantially planar exterior surface of the loop-preserving end cap flange 10 associated with the non-pointed end of the knitting needle shaft 5, which although not shown may optionally (as in the prior art) have markings that identify knitting needle size, manufacturer, and/or other information. Additionally, FIG. 15 is a front end view of the seventh preferred embodiment 22 of the present invention showing its pointed end 7 positioned in front of its additional work area 16, the tapering work area 6 extending between pointed end 7 and additional work area 16. FIG. 15 also shows the area marked by the number 4 behind additional work area 16, which actually represents both shaft 5 and end cap 4 each having a triangular configuration. FIG. 15 further shows the flange 10 having a circular perimeter shape and extending beyond the perimeter of end cap 4. Variations of the seventh preferred embodiment 22 of a present invention knitting needle from that shown in FIGS. 11-15 to create new preferred embodiments of the present invention could also include, but are not limited to, the addition to shaft 5 and/or transition area 21 of one or more elevation changes (13, 14, 15, 20, or other) of any size, shape, or positioning that also provides additional ergonomic to shaft 5 and/or transition area 21; the addition of one or more elevation changes (13, 14, 15, 20, or other) of any size, shape, or positioning to end cap 4 or flange 10; the addition of a mounting projection 2 to flange 10; the addition of one or more decorative markings 18 to tapering work area 6, non-tapering area 16, and/or pointed end 7; the addition of one or more decorative markings 18 to end cap 4 and/or flange 10; a longer transition area 21 than is shown in FIGS. 11 and 13, and providing tapering work area 6 with a tapering configuration more elongated than that shown in FIGS. 11 and 13.

Figure 16:
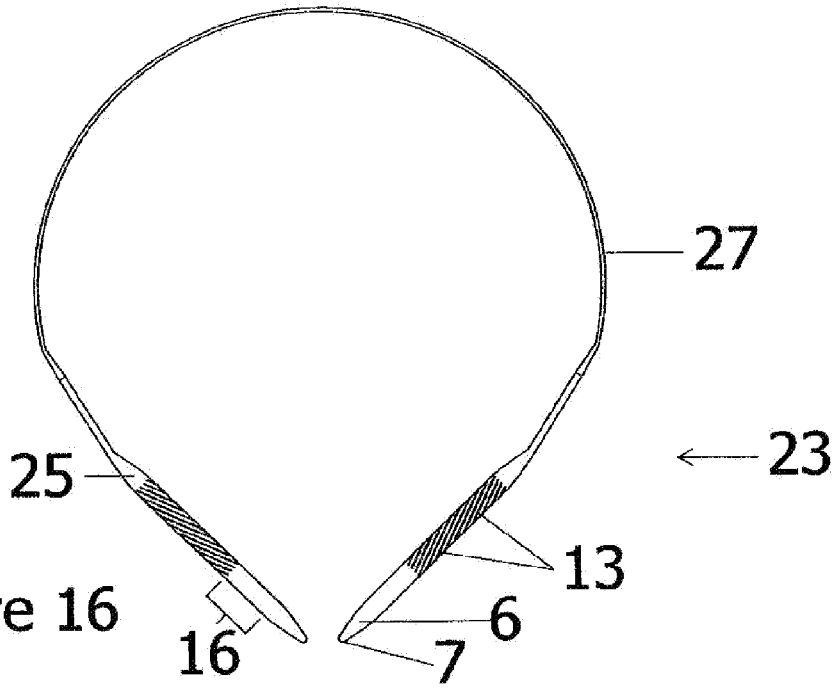
FIG. 16 is a side view of an eighth preferred embodiment of the present invention having the configuration of a circular knitting needle with traditional construction wherein a flexible filament extends between two rigid members each tapered on both of their ends, with each rigid member having a circular cross-sectional configuration, wherein the addition to the traditional construction comprises centrally-located elevation changes on areas of both rigid members where it is anticipated that knitters will be most likely grasp them, with the elevation changes structured to have a linear or spiral configuration providing ergonomic advantage, the elevation changes not extending onto the flexible filament, the pointed end/tip, or the tapering work area adjacent to the pointed end/tip, and each rigid member also having a non-tapering area with a circular cross-sectional configuration and no elevation changes that is located between the elevation changes and the tapering work area adjacent to the pointed tip at the working end of each rigid member whereby two non-tapering areas are able to be used as additional work areas for knitting activity.
Figure 17:
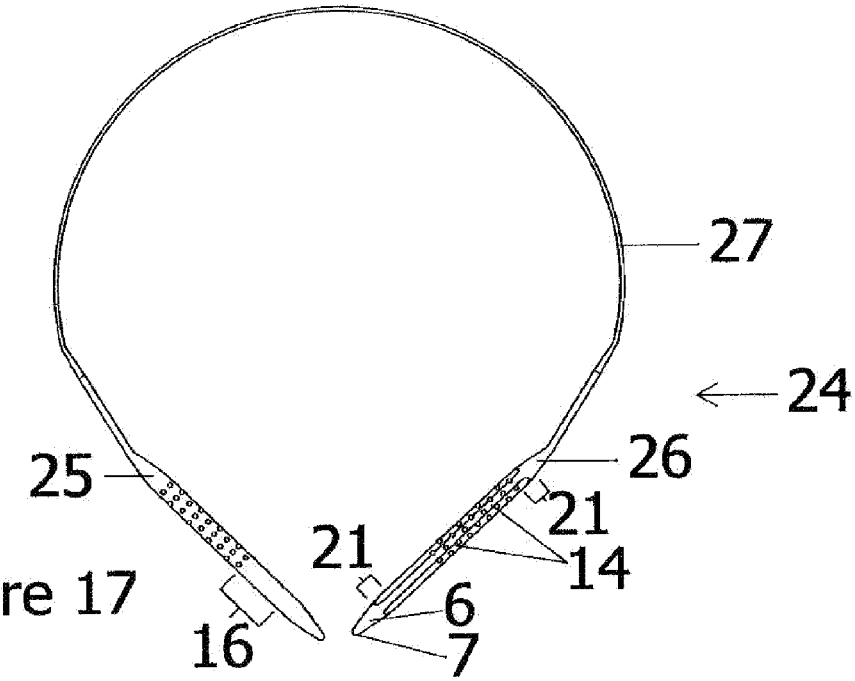
FIG. 17 is a side view of a ninth preferred embodiment of the present invention having the configuration of a circular knitting needle with traditional construction wherein a flexible filament extends between two rigid members tapered on both of their ends, wherein one addition to the traditional construction comprises one rigid member having a circular cross-sectional configuration and the other rigid member having a triangular cross-sectional configuration, and wherein another addition to the traditional construction comprises small elevation changes in rows that are structured to provide ergonomic advantage on the central portions of the two rigid members most likely to be held by knitters, with the elevation changes not extending onto the flexible filament, the pointed end/tip, or the tapering work area adjacent to the pointed end/tip, and each rigid member also having a non-tapering void area with a circular cross-sectional configuration and no elevation changes that is located between the elevation changes and the tapering work area adjacent to the pointed tip at the working end of each rigid member that allows the two non-tapering void areas to become additional work areas for knitting activity.

FIGS. 16 and 17 show two preferred embodiments (respectively marked by the numbers 23 and 24) of circular knitting needle considered to be within the scope of the present invention. FIG. 16 is a side view of an eighth preferred embodiment 23 of the present invention having the configuration of a circular knitting needle with traditional construction wherein a flexible filament 27 extends between two rigid members 25 (generally shorter in length than shafts 5 and 12, and tapered on each of its ends), with each rigid member 25 having a circular cross-sectional configuration, elevation changes 13 in a linear or spiral configuration that provide ergonomic advantage on the central portion of the rigid members 25 most likely to be held by knitters (not shown) during stitch/loop creation and transfer, a void additional work area 16 without elevation changes located between elevation changes 13 and the tapering work area 6 adjacent to the pointed end 7 of each rigid member 25, and no elevation changes (13 or other) extending onto the flexible filament 27. In contrast, FIG. 17 is a side view of a ninth preferred embodiment 24 of the present invention having the configuration of a circular knitting needle wherein a flexible filament 27 extends between two rigid members 25 and 26 (each tapered on both of its ends), with one rigid member 25 having a circular cross-sectional configuration and the other rigid member 26 having a triangular cross-sectional configuration, small elevation changes 14 in rows that provide ergonomic advantage on the central portions of rigid members 25 and 26 that are most likely to be held by knitters (not shown) during stitch/loop creation and transfer, an additional work area 16 without elevation changes located between elevation changes 14 and the tapering work area 6 adjacent to the pointed end 7 at the working end of rigid member 25, and no elevation changes extending on the flexible filament 27. Since flexible filament 27 is not typically handled during the transfer of loops to and from the present invention rigid members 25 and 26 during the formation of new stitches/loops, no ergonomic benefit is anticipated or identified for extending elevation changes (14 or other) to flexible filament 27. However, any elevation changes (14 or other) or decorative markings (18 or other) associated with flexible filament 27 are considered to be within the scope of the present invention and having value for the decorative enhancement or manufacturing advantage they provide. Also, although only elevation changes 13 and 14 are shown in FIGS. 16 and 17, and only circular and generally triangular cross-sectional configurations are shown for rigid members 25 and 26, the FIGS. 16 and 17 that accompany this description only provide examples of several options possible in the present invention when it is configured as a circular knitting needle, and therefore should not be construed as limiting. Furthermore, due to the generally shorter length of a circular knitting needle shaft (such as those having the numbers 25 and 26 in FIGS. 16 and 17) and the taper on its non-working end, the longitudinal extension of elevation changes (13, 14, or other) along its shaft (25, 26, or other) would preferably be a distance of approximately one-and-one-half inches, mainly to provide ergonomic relief to the thumb and opposed index and middle fingers, as the taper on the non-working end of its shaft (25, 26, or other) does not require a tight grip of the ring and little fingers around it that would cause diminished blood circulation therein. Variations of the eighth and ninth preferred embodiments (respectively 23 and 23) of a present invention knitting needle from that shown in FIGS. 16-17 to create new preferred embodiments of the present invention could also include, but are not limited to, the addition of one or more decorative markings 18 to tapering work area 6, non-tapering area 16, and/or pointed end 7; longer transition areas 21 than are shown in FIG. 17; and providing tapering work area 6 with a tapering configuration more elongated than that shown in FIGS. 16 and 17.

Figure 18:
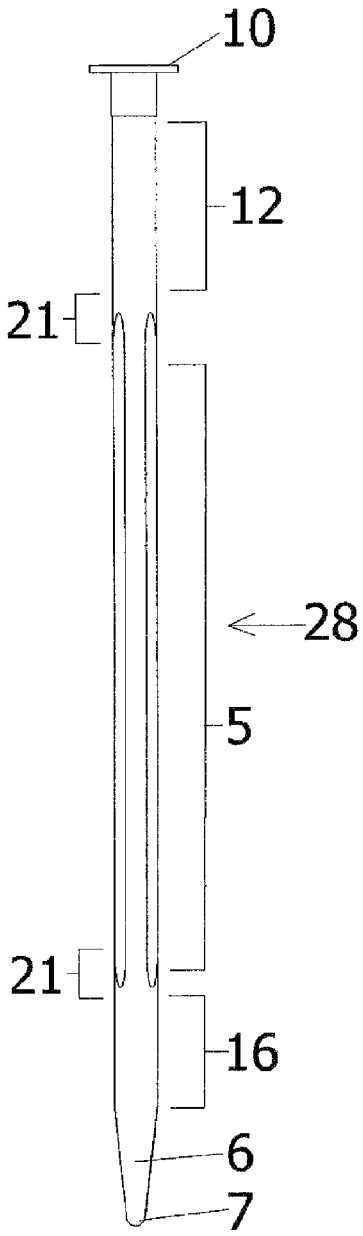
FIG. 18 is a side view of a tenth preferred embodiment of the present invention having the configuration of a single-point knitting needle with a central triangular cross-sectional configuration that transitions on both of its ends into a non-tapering area having a circular cross-section, and also having an end cap with a circular perimeter configuration secured over the end portion of one of the non-tapering areas, with the end cap having a terminal flange with a circular perimeter configuration, with the tenth preferred embodiment further having a tapering work area positioned between the other non-tapering area and a pointed end/tip, with the non-tapering area located adjacent to the tapering work area available to knitters as an additional work area for stitch/loop accumulation and knitting activity needed to complete complex stitch patterns.
Figure 19:
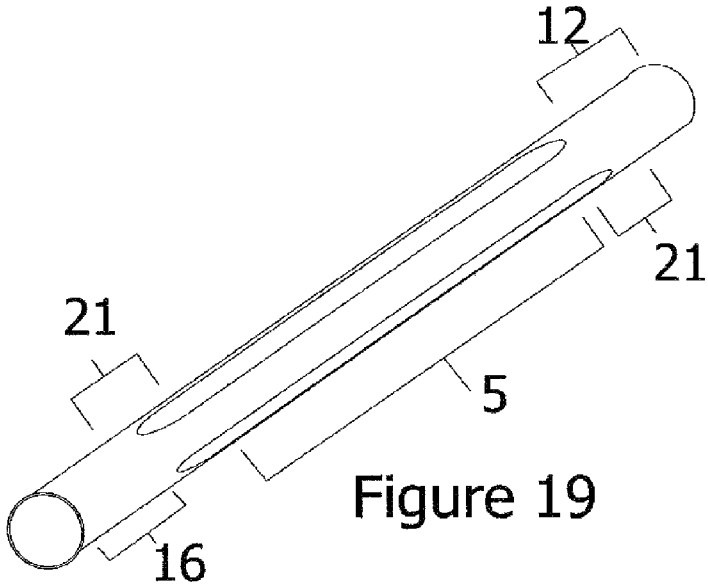

Lastly, FIGS. 18-19 show a tenth embodiment 28 of the present invention as a single-point knitting needle with a generally triangular cross-sectional configuration similar to that shown in FIGS. 1 and 11. However, in contrast to FIGS. 1 and 11, the triangular cross-sectional configuration in FIGS. 18 and 19 are bounded on both of its ends by a transition area 21, each of which also borders on a non-tapering area 16 having a circular cross-sectional configuration, with one non-tapering area 16 being adjacent to tapering work area 6 and pointed end 7 and used to help conduct and/or facilitate stitch/loop creation or transfer, while an end cap having a circular cross-sectional configuration and a flange 10 with a circular perimeter edge is secured to the other non-tapering area 16. The second circular cross-sectional configuration non-tapering area 16 located adjacent to flange 10 is only marked by the number 12, to indicate its circular cross-sectional configuration. The number 16 was omitted from the illustration to avoid the possible confusion involved in having two arrows each associated with a different number pointing to the same feature. FIG. 18 is a side view of the tenth preferred embodiment 28 having the configuration of a single-point knitting needle. Its centrally located shaft 5 has a triangular cross-sectional configuration that transitions on both of its ends (via two transition areas 21) into a non-tapering area 16 having a circular cross-sectional configuration. In contrast, FIG. 19 is a perspective view of a preferred configuration for the knitting needle shaft 5 used in the tenth preferred embodiment 28 of the present invention that transitions (via two transition areas 21) from a generally triangular cross-sectional configuration to a circular cross-sectional non-tapering configuration 16 on both of its ends, with its pointed end 7 and end cap having flange 10 omitted to better reveal the circular cross-sectional configuration on its two ends and the triangular cross-sectional configuration on the portion of shaft 5 in between. As in other embodiments of the present invention, although the configuration shown in FIGS. 18 and 19 would provide ergonomic benefit on their own, the ergonomic benefit provided could be enhanced even more through the addition of elevation changes (13, 14, 15, and other) for efficient, enjoyable, and productive knitting activity with less stiffness and/or soreness in a knitters' hands and fingers, and less risk of repetitive motion injury. Variations of the tenth preferred embodiment 28 of a present invention knitting needle from that shown in FIGS. 18-19 to create new preferred embodiments of the present invention could also include, but are not limited to, the addition of one or more elevation changes (13, 14, 15, 20, or other) of any size, shape, thickness, depth, or positioning to transition area 21 or flange 10; the addition of a mounting projection 2 to flange 10; the addition of one or more decorative markings 18 to tapering work area 6, non-tapering area 16, and/or pointed end 7; the addition of one or more decorative markings 18 to flange 10; a longer transition area 21 than is shown in FIGS. 18 and 19; and providing tapering work area 6 with a tapering configuration more elongated than that shown in FIG. 18.

In summary, it is contemplated for the elevation changes (13, 14, 15, 20, or other) in some preferred embodiments of the present invention to extend from a position substantially close to the stitch-retaining end cap 4 or 11 on the non-pointed end of a knitting needle (when there is a non-pointed end) to a position having a minimum distance of approximately one-and-one-half inches to two inches from the knitting needle's pointed end 7. Thus, through its use, there is an opportunity for variation in the knitter's hand and finger positioning and frequent re-alignment thereof with differing topography created by the exterior shaft surface and its associated elevation changes (13, 14, 15, 20, or other), and as a result differing portions of the knitter's fingers and hands are periodically allowed to experience increased blood circulation and fatigue recovery, making them less likely to become tired and/or numb should long periods of knitting activity be attempted. For double-pointed present invention knitting needles (17, 19, and other), the ergonomic shape and any elevation changes (13, 14, 15, 20, or other) would preferably be present centrally and extend to a position approximately one-and-one-half inches to two inches from each pointed end 7 (or at least extend over the centrally-positioned areas most likely to be held by a knitter during stitch/loop creation). Furthermore, in circular needles (23, 24, and other) it is contemplated for the elevation changes (13, 14, 15, 20, or other) to extend substantially across each of the two pointed rigid members (25, 26 or other) that are employed for user gripping and end in a position approximately one-and-one-half inches to two inches from each rigid member's pointed end 7 (so that stitches will still be able to slide easily off the tip of one rigid member (25, 26 or other) and onto the other (or at least extend over the centrally-positioned areas thereof most likely to be held by a knitter during stitch/loop creation). Manufacturing of non-circular present invention knitting needle shafts, such as but not limited to the triangular shaft 5 in FIG. 1, can begin with a circular shape that is centrally crimped to provide the triangular configuration 9 with softened corners or another non-circular configuration desired. Furthermore, the material from which the present invention shaft (5, 12, or other) is made would preferably be a lightweight metal, plastic, wood, or bamboo, although other lightweight materials or combinations that would allow for easy movement of loops across shaft (5, 12, or other) are also considered to be within the scope of the present invention.

What is claimed is:

1. A knitting needle providing ergonomic benefit to a knitter holding it with the fingers and hands and using it with at least one other similarly configured knitting needle to make knitted loops with an elongated strand in arrangements that create two-dimensional and three-dimensional shapes, wherein until the intended shape is completed, loops are stored on at least one such knitting needle and then transferred with and sometimes without the addition of newly knitted loops repeatedly from at least one such knitting needle as a donor needle to a recipient needle while the intended shape's surface texture is produced and its size continually increases, said knitting needle comprising:

an elongated shall having at least one pointed end and a tapering work area adjacent to said at least one pointed end, said elongated shaft also having an exterior surface; and multiple spaced-apart and mixed-level elevation changes associated with said exterior surface of said elongated shaft each having a perimeter configuration that does not create drag and does not diminish sliding of loops across donor and recipient needles, said elevation changes also being selected from a group consisting of elevation changes having a thickness dimension and extending outwardly beyond said exterior surface of said elongated shaft and elevation changes having a depth dimension and extending below said exterior surface of said elongated shaft, said elevation changes further extending laterally around said shaft and along said shaft away from said at least one pointed end starting at least from a location of approximately one to two-and-one-half inches from said at least one pointed end, said elevation changes also only partially covering said exterior surface while creating a varied topography that gives knitters many opportunities to vary contact point alignment between the elongated shaft and the knitter's fingers and hand holding it, that provides pressure relief to portions of the knitter's fingers and hand during the creation and transfer of knitted loops from donor to recipient knitting needles, with the opportunity for frequent readjustment of finger and hand positioning around said shaft such that the fingers and hand holding said elongated shaft repeatedly encounter differing selections of said elevation changes and pressure relief topography each of the many times said shaft is re-grasped by the knitter's fingers and hand during knitting activity, thus allowing the opportunity for knitting activity involving at least two of said elongated shafts to occur with enhanced comfort of the knitter's fingers and hand holding it, greater speed, and for longer periods of time while reduced incidence of repetitive motion injury, less pain, reduced joint damage, less incidence of hands becoming prematurely tired before the knitter wants to stop, less incidence of hands and fingers becoming numb, and less incidence of hands and fingers aching from the repetitive motion inherent in knitting activity are also experienced.

2. The knitting needle of claim 1 wherein said elevation changes are selected from a group consisting of raised protrusions having a thickness dimension and extending outwardly beyond said exterior surface of said elongated shaft, depressions having a depth dimension and extending below said exterior surface of said elongated shaft, channels having a depth dimension and extending below said exterior surface of said elongated shaft, grooves having a depth dimension and extending below said exterior surface of said elongated shaft, one raised protrusion in a spiral pattern, more than one raised protrusion in a spiral pattern, elevation changes having a small diameter dimension, elevation changes having a small length dimension, elevation changes having a small width dimension, elevation changes spaced apart from one another in rows, elevation changes oriented in a staggered pattern, elevation changes having a single width dimension, multiple elevation changes at least two of which have different width dimensions, elevation changes having a single length dimension, multiple elevation changes at least two of which have different length dimensions, elevation changes having a single diameter dimension, multiple elevation changes at least two of which have different diameter dimensions, elevation changes having similar spaced apart distances from one another, multiple elevation changes having at least two different spaced-apart distances from one another, elevation changes all having the same thickness dimension, multiple elevation changes at least two of which have different thickness dimensions, elevation changes all having the same depth dimension, and multiple elevation changes at least two of which have different depth dimensions.

3. The knitting needle of claim 1 having one said shaft configured as a single-point knitting needle with one said pointed end and a non-pointed end in a position opposed from said pointed end, said knitting needle further comprising an end cap configured for secure connection to said non-pointed end of said shaft, with said end cap having a mounting projection extending away from said pointed end of said knitting needle and configured to temporarily provide a fixed position for a knitting needle point protector while knitting activity occurs, with the point protector then remaining close to the knitter so that it can be readily accessed for use over said pointed end of said knitting needle after knitting activity ceases, to prevent loops remaining on said shaft from inadvertently traveling beyond said pointed end while knitting activity is temporarily suspended.

4. The knitting needle of claim 3 wherein said end cap further comprises a flange with an anti-roll perimeter configuration.

5. The knitting needle of claim 3 wherein said end cap further comprises a non-circular cross-sectional configuration.

6. The knitting needle of claim 1 further comprising a second one of said elongated shafts and a flexible filament, said knitting needle configured as a circular knitting needle with said flexible filament attached to and separating said two elongated shafts, said elongated shafts also each having a pointed end and a tapering work area adjacent to said pointed end, and further with at least one of said shafts having a non-circular cross-sectional configuration.

7. The knitting needle of claim 1 wherein said shaft further comprises a non-circular cross-sectional configuration.

8. The knitting needle of claim 7 wherein said elevation changes have a minimum thickness dimension of approximately 0.0004 inches.

9. The knitting needle of claim 7 wherein said shaft further comprises a non-tapering additional work area having circular cross-sectional configuration, said non-tapering additional work area also being positioned adjacent to said tapering work area and configured without any of said elevation changes.

10. The knitting needle of claim 9 further comprising decorative markings associated with said tapering work area and said non-tapering additional work area adjacent thereto.

11. The knitting needle of claim 9 wherein said shaft further comprises a non-tapering area having circular cross-sectional configuration adjacent to said non-pointed end, and wherein said end cap is configured for secure attachment to said non-tapering circular cross-section area.

12. The knitting needle of claim 9 further comprising a transition area between said non-tapering additional work area having circular cross-sectional configuration and said non-circular cross-sectional configuration of said shaft.

13. The knitting needle of claim 1 further comprising decorative markings selected from a group consisting of decorative markings associated with said tapering work area, decorative markings associated with said pointed end, and decorative markings substantially flush with said exterior surface of said shaft.

14. The knitting needle of claim 13 wherein said decorative markings are further selected from a group consisting of decorative markings having the same shape as said elevation changes associated with said shaft, decorative markings having a different shape from said elevation changes associated with said shaft, and decorative markings having an appearance similar to that of said elevation changes on said shaft to provide a non-distinct visual extension of said elevation changes.

15. A method for making the ergonomically beneficial knitting needle of claim 7, said method comprising the steps of:

providing said elongated shaft with said non-circular cross-sectional configuration and said exterior surface; and associating spaced-apart and mixed-level elevation changes with said exterior surface of said elongated shaft without associating said elevation changes with said tapering work area so that said elevation changes extend along said shaft away from said pointed end starting at least from a location of approximately one to two-and-one-half inches from said at least one pointed end, said elevation changes each having a perimeter configuration that does not create drag and diminish sliding of loops across donor to recipient needles, said elevation changes also only partially covering said exterior surface while creating a varied topography that gives knitters many opportunities to vary contact point alignment between the elongated shaft and the knitter's fingers and hand holding it, which provides pressure relief to portions of the knitter's fingers and hand during the creation and transfer of knitted loops from donor to recipient knitting needles, with the opportunity for frequent readjustment of finger and hand positioning around said shaft such that the fingers and hand holding said elongated shaft repeatedly encounter differing selections of said elevation changes and pressure relief topography each of the many times said shaft is regrasped by the knitter's fingers and hand during knitting activity, thus allowing the opportunity for knitting activity involving at least two of said elongated shafts to occur with enhanced comfort of said fingers and hand holding it, greater speed, and for longer periods of time while knitting activity also occurs with reduced incidence of repetitive motion injury, less pain, reduced joint damage, less incidence of hands becoming prematurely tired before the knitter wants to stop knitting, less incidence of hands and fingers becoming numb, and less incidence of hands and fingers aching from the repetitive motion inherent in knitting activity are also experienced.

16. The method of claim 15 further comprising the step of providing of decorative markings and the step of associating said decorative markings with said tapering work area.

17. The method of claim 16 wherein said steps of providing said decorative markings and associating said decorative markings with said tapering work area can occur before or after said step of associating said at least one raised protrusion with said exterior surface of said elongated shaft.

18. The method of claim 15 wherein said at least one shaft further comprises a non-tapering additional work area positioned adjacent to said tapering work area and having a circular cross-sectional configuration, said non-tapering additional work area also being configured without said elevation changes.

19. The method of claim 15 further comprising the step of providing of decorative markings and the step of associating said decorative markings with said tapering work and said non-tapering additional work area.

20. The method of claim 19 wherein said steps of providing said decorative markings and associating said decorative markings with said tapering work area and said non-tapering work additional area can occur before or after said step of associating said at least one raised protrusion with said exterior surface of said elongated shaft.

* * * * *